US008075054B2

(12) United States Patent
Smith

(10) Patent No.: US 8,075,054 B2
(45) Date of Patent: Dec. 13, 2011

(54) AMPERE MODULAR TANDEM SEATING SYSTEM

(76) Inventor: Laura Lisa Smith, New York, NY (US)

( * ) Notice: Subject to any disclaimer, the term of this patent is extended or adjusted under 35 U.S.C. 154(b) by 482 days.

(21) Appl. No.: 12/163,587

(22) Filed: Jun. 27, 2008

(65) Prior Publication Data

US 2009/0001775 A1 Jan. 1, 2009

Related U.S. Application Data

(60) Provisional application No. 60/946,631, filed on Jun. 27, 2007.

(51) Int. Cl.
*A47C 15/00* (2006.01)

(52) U.S. Cl. ..... 297/217.3; 297/232

(58) Field of Classification Search ..... 297/217.3, 297/217.4, 217.6, 232, 248
See application file for complete search history.

(56) References Cited

U.S. PATENT DOCUMENTS

| | | | | | |
|---|---|---|---|---|---|
| 3,002,787 | A | | 10/1961 | Ziegenfuss | |
| 3,019,050 | A | | 1/1962 | Speilman et al. | |
| 3,261,640 | A | * | 7/1966 | Straits | 297/135 |
| 3,494,662 | A | | 2/1970 | Schaefer et al. | |
| 3,811,728 | A | | 5/1974 | Redemske | |
| D237,328 | S | * | 10/1975 | Vogt | D6/336 |
| 3,990,741 | A | | 11/1976 | Snyder | |
| 4,060,277 | A | | 11/1977 | Leib | |
| 4,662,679 | A | | 5/1987 | Franck et al. | |
| 4,753,036 | A | | 6/1988 | Konno | |
| D298,784 | S | * | 12/1988 | Friedman | D6/335 |
| 5,083,838 | A | | 1/1992 | Maxwell | |
| 5,121,698 | A | * | 6/1992 | Kelley | 108/143 |
| 5,163,733 | A | | 11/1992 | Maxwell | |
| 5,292,177 | A | | 3/1994 | Balderi | |
| 5,318,340 | A | * | 6/1994 | Henry | 297/232 |
| 5,329,716 | A | * | 7/1994 | Fite | 297/217.6 |
| 5,671,975 | A | | 9/1997 | Muller | |
| 5,943,966 | A | | 8/1999 | Machado | |
| 5,957,529 | A | | 9/1999 | Schrewe | |
| 5,984,415 | A | | 11/1999 | Schumacher et al. | |
| 6,179,381 | B1 | | 1/2001 | Gevaert | |
| 6,683,394 | B1 | | 1/2004 | Gevaert | |
| 6,824,213 | B2 | | 11/2004 | Skelly et al. | |
| 6,843,681 | B2 | * | 1/2005 | Sanner | 297/217.3 |
| 7,036,889 | B2 | | 5/2006 | Sanfrod et al. | |
| 7,131,699 | B2 | | 11/2006 | Mulmed | |
| 7,178,871 | B1 | | 2/2007 | Round et al. | |
| 7,252,332 | B2 | | 8/2007 | Thompson | |
| 2005/0067865 | A1 | | 3/2005 | Yu | |
| 2005/0140184 | A1 | | 6/2005 | Williams et al. | |
| 2006/0175882 | A1 | | 8/2006 | Schweizer | |

FOREIGN PATENT DOCUMENTS

| | | |
|---|---|---|
| GB | 2395427 | 5/2004 |

* cited by examiner

*Primary Examiner* — Peter R. Brown
(74) *Attorney, Agent, or Firm* — Alston & Bird LLP

(57) ABSTRACT

A seating system designed to accommodate a variety of activities that can be performed while a person is sitting or resting, and more particularly waiting. A single tandem row of seats or a back to back configuration of tandem seats has an electrical wire way extending behind or between each seat back, respectively. A cover plate encloses the wire way, and a plurality of electrical and data ports are accessible from the cover plate. Laptop computers, music players and other electrical devices can be plugged into the seating system so that the user can comfortably operate such a device while waiting.

20 Claims, 23 Drawing Sheets

AMPERE MODULAR TANDEM SEATING SYSTEM

This application claims priority from U.S. Application No. 60/946,631 filed Jun. 27, 2007.

BACKGROUND OF THE INVENTION

1. Field of the Invention

The present invention is directed to furniture for sitting or resting, and more particularly to seating for a transient population. Embodiments of the present invention allow for people to perform certain activities while waiting, including working on a computer, listening to music, or operating an electrical device.

2. Description of Related Art

There are many seating systems that support the various activities that people perform while waiting, such as reading, conversing, eating/drinking or just relaxing in a comfortable environment. Yet, such systems tend to lack capabilities that support more advanced activities such as working on laptops, listening to music, plugging into data sources and powering-up electronic devices. All of these activities could ideally be performed while waiting in an airport/transportation depot, hotel lobby, healthcare clinic, educational study facility or other space (indoors or outdoors) that is designated for waiting.

Unlike the present invention, other seating groups which incorporate electrical access run the electrical wiring under the seats or through a beam. For example, in U.S. Pat. No. 6,179,381, the electrical connection extends from the seat back through the arm and is dedicated to each sitter at the arm location. The plug for powering-up is dedicated to each seat for its use in classroom training. Further, in this prior invention, all the seats are facing in the same direction, as in a lecture hall. In U.S. Pat. No. 6,683,394, which covers a power and data distribution system for use in combination with a beam-mounted seating structure that includes a series of seat assemblies each mounted to a common support beam, the power and data distribution system includes a wire way that is mounted to the support beam and extends along the entire row of seats. The power and data distribution system is separate from the seating structure and can be attached and removed from the seating structure independent from the construction of the seating structure. U.S. Pat. No. 6,284,213 has a hollow beam housing electrical wiring which runs underneath the front of a row of passenger seats. In United Kingdom Patent Application No. GB 2395427, the electrical interface is in the armrest or the front face of the seating element.

In airplane seating, such as U.S. Pat. Nos. 5,984,415 and 7,036,889, the electronic devices located at the back of the seats are placed there for the benefit of the user in the seat rows behind. Unlike the present invention, the seats of the above mentioned patents are always arranged forward facing, as in an airplane. Further, in U.S. Pat. Nos. 5,984,415 and 7,036,889 an electrical or data connection is dedicated to each passenger unit through the arm of the seat.

BRIEF SUMMARY OF THE INVENTION

The present invention relates to furniture systems that may be used in waiting areas, such as transportation waiting areas, hotel lobbies, hospitals and healthcare facilities, educational facilities, and other spaces (indoors or outdoors) that are designated for waiting. While many seating systems in waiting areas support only basic activities such as sitting, reading or eating/drinking, the invention described herein allows for the sitter to do much more, thereby enhancing a person's waiting experience. The central element that supports advanced activities in the present invention, such as working on laptops, listening to music, powering-up an electrical device, is an electrical wire way.

In a preferred embodiment of the present invention, the electrical wire way is behind the seat back in a single line of tandem seating and in between seat backs in a back to back seating configuration. The electrical wire way provides the sitter with access to electrical and data ports while he/she is waiting at the airport/transportation depot, hotel lobby, healthcare clinic, educational facility or other area (inside a building or outside) that is designated for waiting. In the case of the present invention's placement in an open environment, electrical grounding would be necessary. This unique electrical wire way facilitates powering-up and plugging in electronic devices and data either through electrical/data ports or battery charging through electrical coupling plates.

In one embodiment of the present invention, the sitter plugs into the electrical and data ports provided on the cover plate of the electrical wire way provided behind the seat frame. The sitter may drape the electrical wires next to his/her lap while using the laptop or other electronic device. If the computer user can not take a seat directly near a plug, the wire way cover can serve as a surface to run the wire until it reaches the sitter who is plugging into an electrical or data port. One can also place his/her computer or handset device on to the wire way cover where a battery coupling plate may be provided in order to charge the battery of the laptop computer or handset via battery coupling (as in an ecouple battery charger plate).

In an another embodiment of the present invention, the electrical wiring and data outlets are behind the sitter rather than at the arm of each seat, thereby making the installation of this invention less expensive and not dedicated to each sitter, as in the case of electrical ports in tandem seating, for instance, in a lecture hall or on an airplane. In the present invention, since the arm does not have an electrical interface for each seat, the arm is optional. In the case of the back to back seating configuration, by sharing the same wire way and plug access, the present invention saves material, electrical wiring and interfaces. Initial electrical installation is less expensive and retrofitting of the present invention's tandem seating design is easy and inexpensive because there is easy access to the wiring through the top cover plate. Electrical and data ports are not dedicated to each seat arm or seat side, as on the seat on a beam construction, for example in U.S. Pat. No. 6,683,394.

In a further embodiment of the present invention, the electrical and data ports are installed on the cover plate above the wire way which is behind the single line of tandem seats. The wire way and cover plate are also between the back to back tandem seating arrangement or configuration. In the back to back seating arrangement, the electrical wire way is common to seats facing away from one another thereby eliminating a separate electrical wire way and plug for these back to back row of seats. Back to back seating arrangements are typical in airports/transportation depots, healthcare facilities, and other indoor and outdoor spaces designated for waiting. Preferably, the electrical wire way has electrical wiring that can accommodate at least one (1) plug per ten (10) seating units or up to ten (10) plugs for ten (10) seating units, and can be easily accessed through the top cover plate and retrofitted for any number of electrical or data plugs/ports. For each electrical plug/port, it is suggested that there be an equal number of data plugs/ports. The data ports may include access to an internet cable. However, the seating system may also utilize a wireless internet source, such that the wireless hub is placed within the wire way, and users can access the internet merely by sitting in the seating system or standing within a close proximity.

In another embodiment of the present invention, the furniture system supports watching television. A TV monitor is installed in the backside of the electrical wire way such that people sitting on that particular configuration of seats or nearby seating systems can watch television while waiting. In addition to electrical wiring, cable wiring may run through the wire way thereby providing the sitter with numerous television channels to watch.

In an additional embodiment of the present invention, a table or many tables are incorporated into the furniture system so that the sitter can set a variety of objects on the table, including but not limited to food and/or drink.

In a still further embodiment of the present invention, the furniture system gives the sitter a comfortable reading environment. In this embodiment, a storage box can be included within the cover plate and inserted into the wire way. The storage box can be used as a receptacle for storing various periodicals, such as magazines and newspapers. In the alternative, the storage box can be used to house fake plants thereby improving the appearance of the waiting area. Generally speaking, the storage box can be used to hold a number of items that would improve the waiting experience. The electrical and data wires are aligned such that any storage box can easily fit into the wire way without disturbing the electrical and data sources. A cylindrical container can also be inserted within the cover plate and used alternatively or in conjunction with a storage box. An electrical or data port/plug can be placed on that portion of the cover plate that remains. In the alternative, for locations where liquids could spill, a power grommet, such as a Douglass Mocket PCS39/EEHW power grommet, may extend through an aperture in the cover plate. Additionally, one or more lights may be plugged into the electrical outlet in order to enhance the reading environment. The light may be plugged into the surface of the cover plate or alternatively below the cover plate should the specifier want the light to be a permanent fixture.

In another embodiment of the present invention, a power grommet, such as a Douglas Mockett PCS34, can be placed within the wire way such that the electrical source can be reached through an aperture in the cover plate. By enclosing the power source, this embodiment is preferred for places where liquids may be spilled.

In a further embodiment of the present invention, a table can be placed above the cover plate in a single line of tandem seats. Having a table of higher elevation than the cover plate provides a surface for persons to be able to work, read, relax and the like while standing. In particular, this surface will be able to provide an ideal surface for a person to use his/her computer while standing. This embodiment allows many persons to take advantage of the electrical and data plugs/ports, in addition to those sitting in the seats.

It is suggested that the furniture system be made of a sustainable material, such as molded plastic, formaldehyde-free medium density fiberboard (MDF) or certified wood, so that the furniture system can withstand significant use over a long duration of time while being environmentally friendly. A material, such as natural latex foam, is also a sustainable material and ideal upholstery for the seats. Other sustainable upholstery materials are flame retardant textiles, compostable stretch fabrics, chrome-free leathers, organic leathers, compostable felt, sustainable textiles, cellulose fabric, post-consumer recycled polyester, hemp and polymer-blended textiles. Useful examples of these upholstery materials include those marketed under the following trade names: Climatex® LifeguardFR™, Q Collection 2005 Climatex Collection®, Climatex® Lifecycle™Natural Stretch, Ecco-La leather, Sustana® leather, Felt Climatex® Lifecycle™, LIFE (Low Impact for the Environment) Textiles®, and Terratex™.

The tables are also preferably constructed of sustainable materials, such as the combination of phenolic resins and paper fiber, bamboo, reclaimed agricultural fiber, plantation-grown coconut palms, composite material of burled wood and sunflower seed husks, waste wood particleboard, high density polyethylene, non-toxic co-polyester resin, high pressure laminates made from recycled laminate scraps, formaldehyde-free medium density fiberboard (MDF), certified wood and laminate made with abaca. Useful examples of such materials include those sold under the PaperStone™, Plyboo®, Plyboo Strand®, Kirei Board, Durapalm®, Dakota Burl®, 100 Percent, Ecoresin™, Tefor®, ALLGREEN® MDF, Medite® II, Medex®, Medite® FR and Abacá™ brands. Other suggested materials for the tables are linoleum surface laminate, for example that sold under the eoLin® brand, hardwood plywood and linoleum-laminated wood sheets. Nevertheless, this invention covers any material the manufacturer and specifier of the product would find suitable for the furniture system, the upholstery and the tables.

In one embodiment of the invention, the seats of the seating system of the present invention may rest on a lower leg frame made of various materials, such as metal, plastic or wood. In other embodiments of invention, the seats may rest on a base or on the floor.

When the present invention is located in a public setting, the power and data sources provided to the user can be administered on a metered basis. For instance, there may be a receptacle for depositing cash or charging a credit/debit card so that the user can pay a certain amount of money for a certain unit of time during which he/she can access the power and data sources. Alternatively, a meter could be activated by a call to a specified number (preferably from a mobile phone). When the call is answered, the user can enter a code which specifies an account to be changed. The user could also specify which outlet is to be activated and optionally for how long.

In various embodiments of the present invention, the seats may be arranged in configurations including, but not limited to: 1) a single line or arc of tandem seats, 2) a back to back line or arc of tandem seats, 3) a single line or arc of tandem seats that are connected to another single line or arc of tandem seats creating an inside corner for the sitters, 4) a single line or arc of tandem seats that are connected to another line or arc of seats creating an outside corner for the sitters, 5) a back to back line or arc of tandem seats that are connected to another back to back line or arc of tandem seats creating an inside corner for the sitters, and 6) a back to back line or arc of tandem seats that are connected to another back to back or single line or arc of tandem seats creating an outside corner for the sitters.

BRIEF DESCRIPTION OF SEVERAL VIEWS OF THE DRAWINGS

Figure 3:
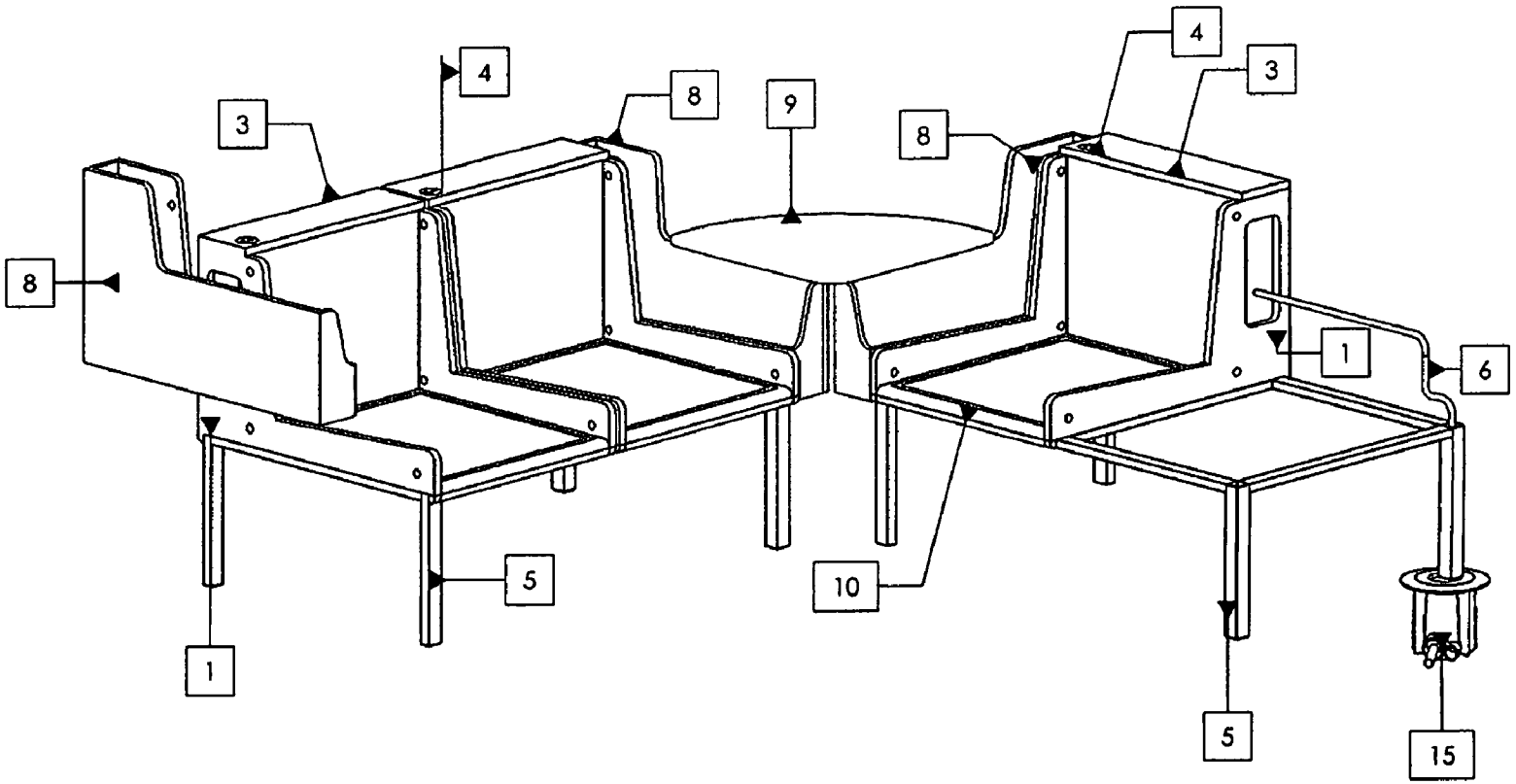

Having thus described the invention in general terms, reference will now be made to the accompanying drawings, which are not necessarily drawn to scale. For an initial overview of the invention, FIG. 3 provides a front view of one such embodiment.

Figure 1:
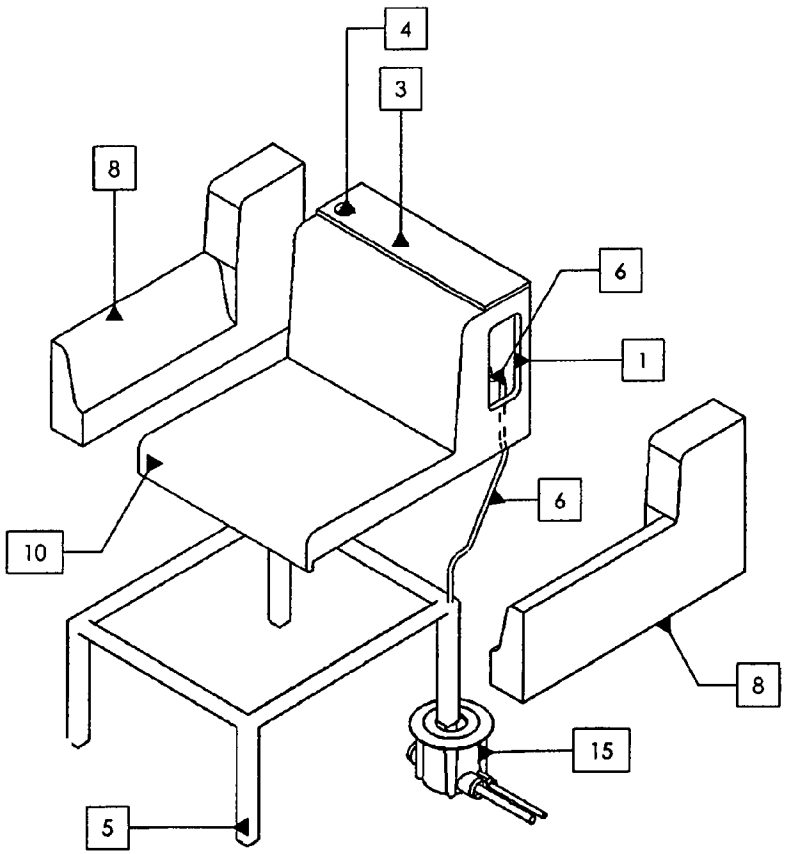

FIG. 1 is an exploded view of a single seat frame according to one embodiment of the invention.

Figure 1A:
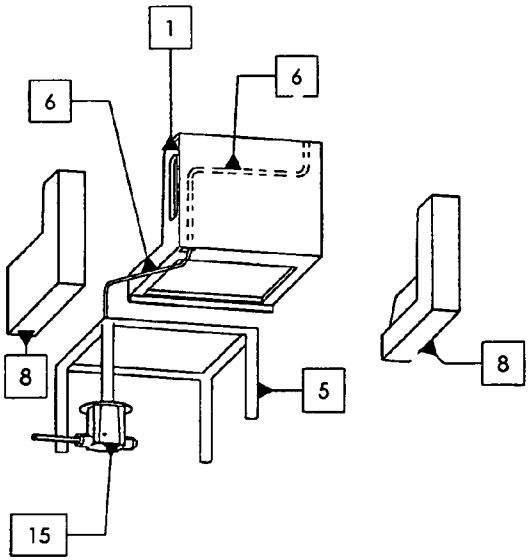

FIG. 1A is a back view of an exploded view of a single seat frame showing the path the electrical wiring takes through the seating system according to one embodiment of the invention.

Figure 1B:
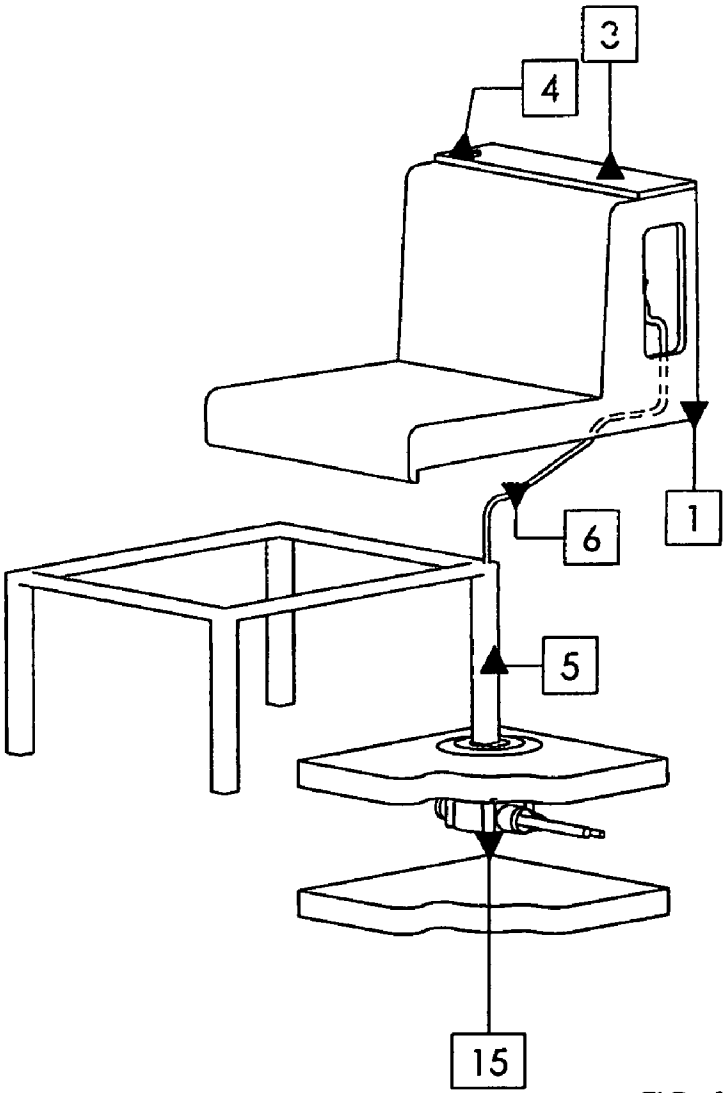

FIG. 1B is an exploded view of a single seat frame showing the placement of an electrical floor box assembly relative to the floor according to one embodiment of the invention.

Figure 1C:
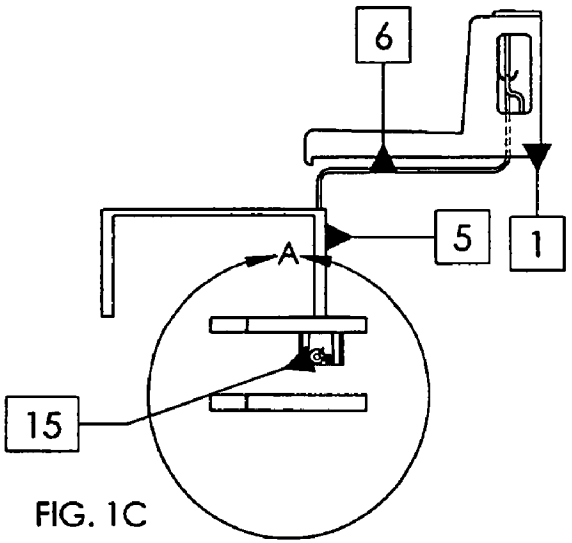

FIG. 1C is an exploded side view of a single seat frame showing the placement of an electrical floor box assembly relative to the floor according to one embodiment of the invention.

Figure 1D:
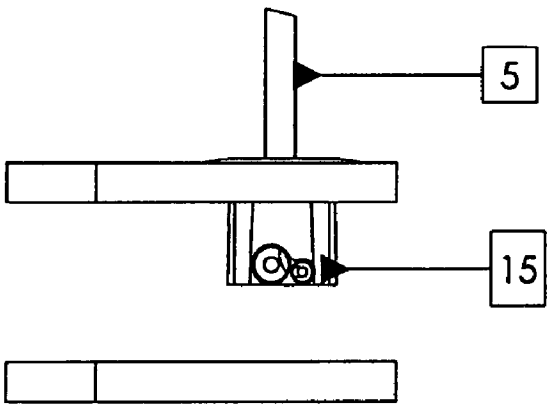

FIG. 1D is a closer view of the electrical floor box assembly of FIG. 1B relative to the floor according to one embodiment of the invention.

Figure 2:
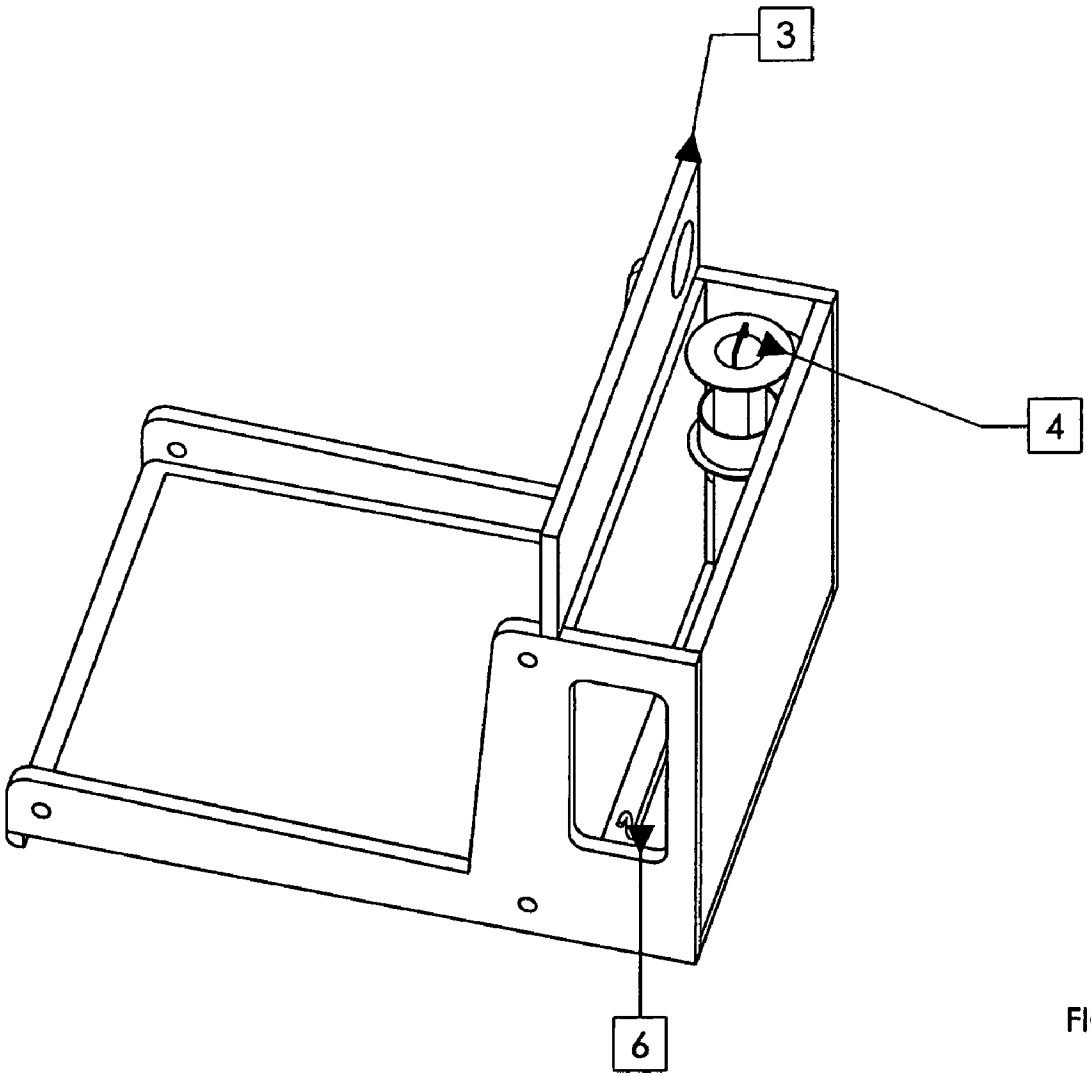

FIG. 2 is a top view of a single seat according to one embodiment of the invention, in particular a top view of the electrical wire way.

FIG. 3 is a front perspective of two single lines of tandem seats creating an inside corner for the sitters according to one preferred embodiment of the invention.

Figure 3A:
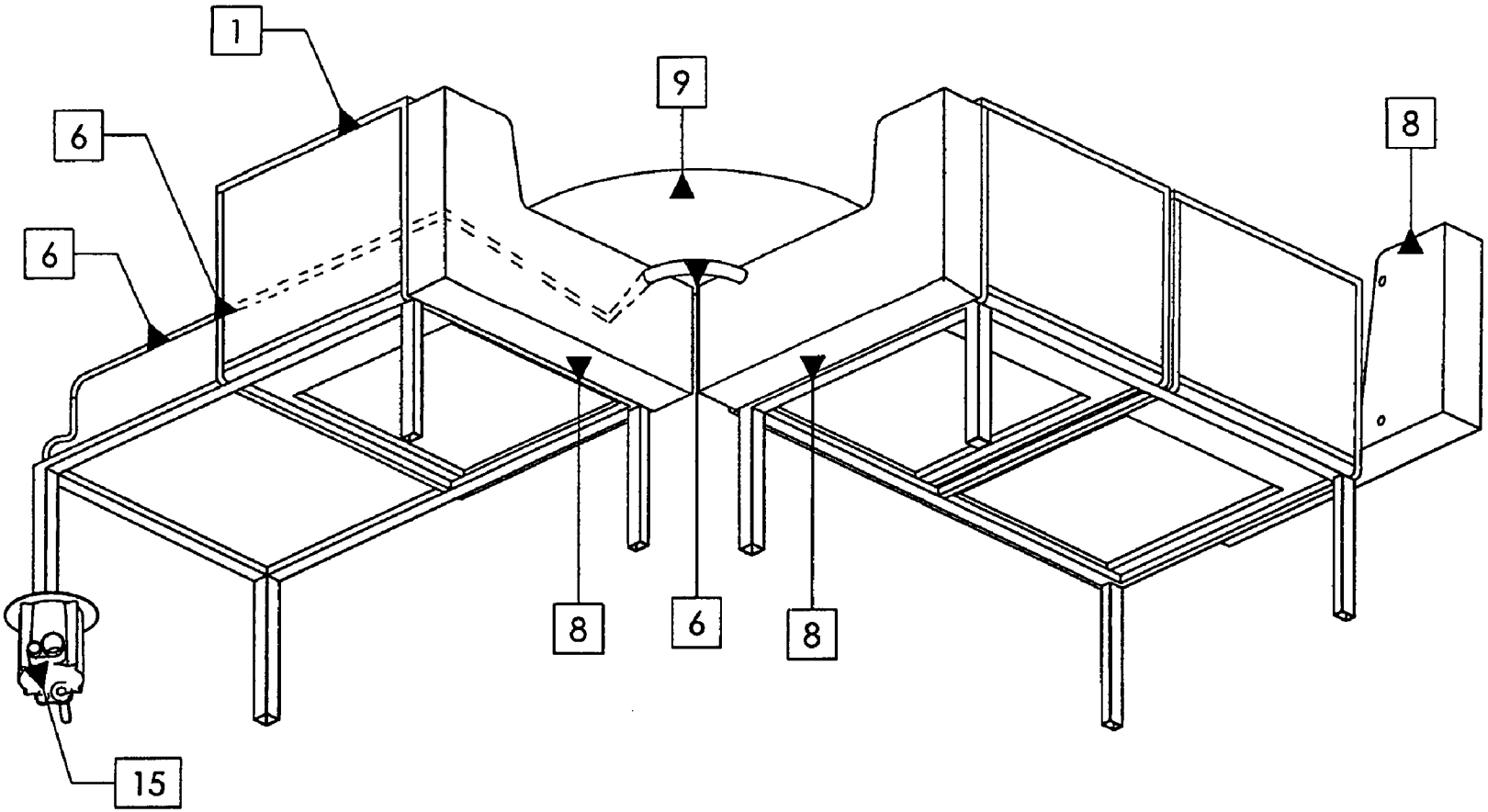

FIG. 3A is a rear bottom perspective of two single lines of tandems seats that are connected creating an inside corner which includes a table according to one preferred embodiment.

Figure 3B:
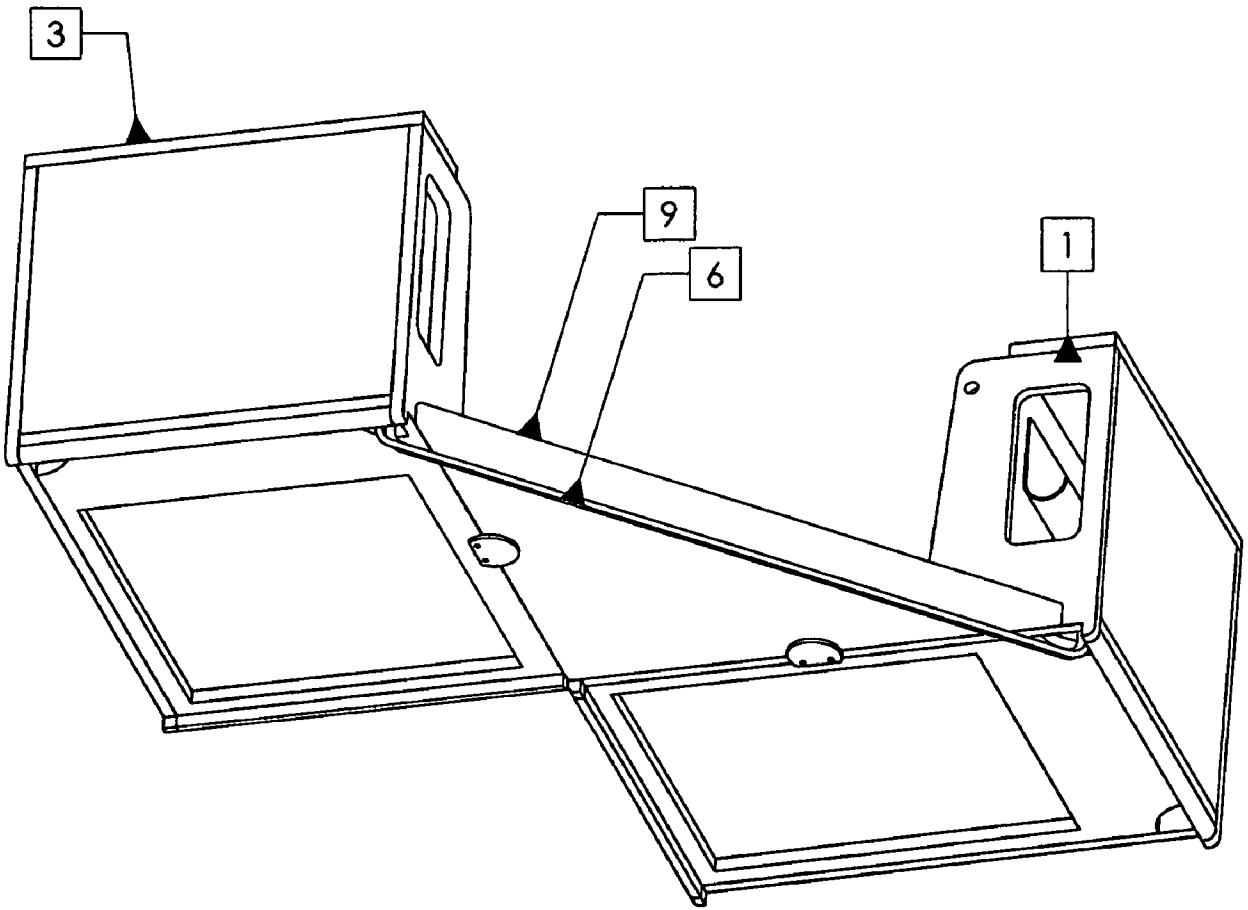

FIG. 3B is a rear bottom perspective of an inside corner created by two single lines of tandem seats showing the passage of the electrical wiring from one electrical wire way, along the edge of a table, and into a second electrical wire way, according to one embodiment of the invention.

Figure 4:
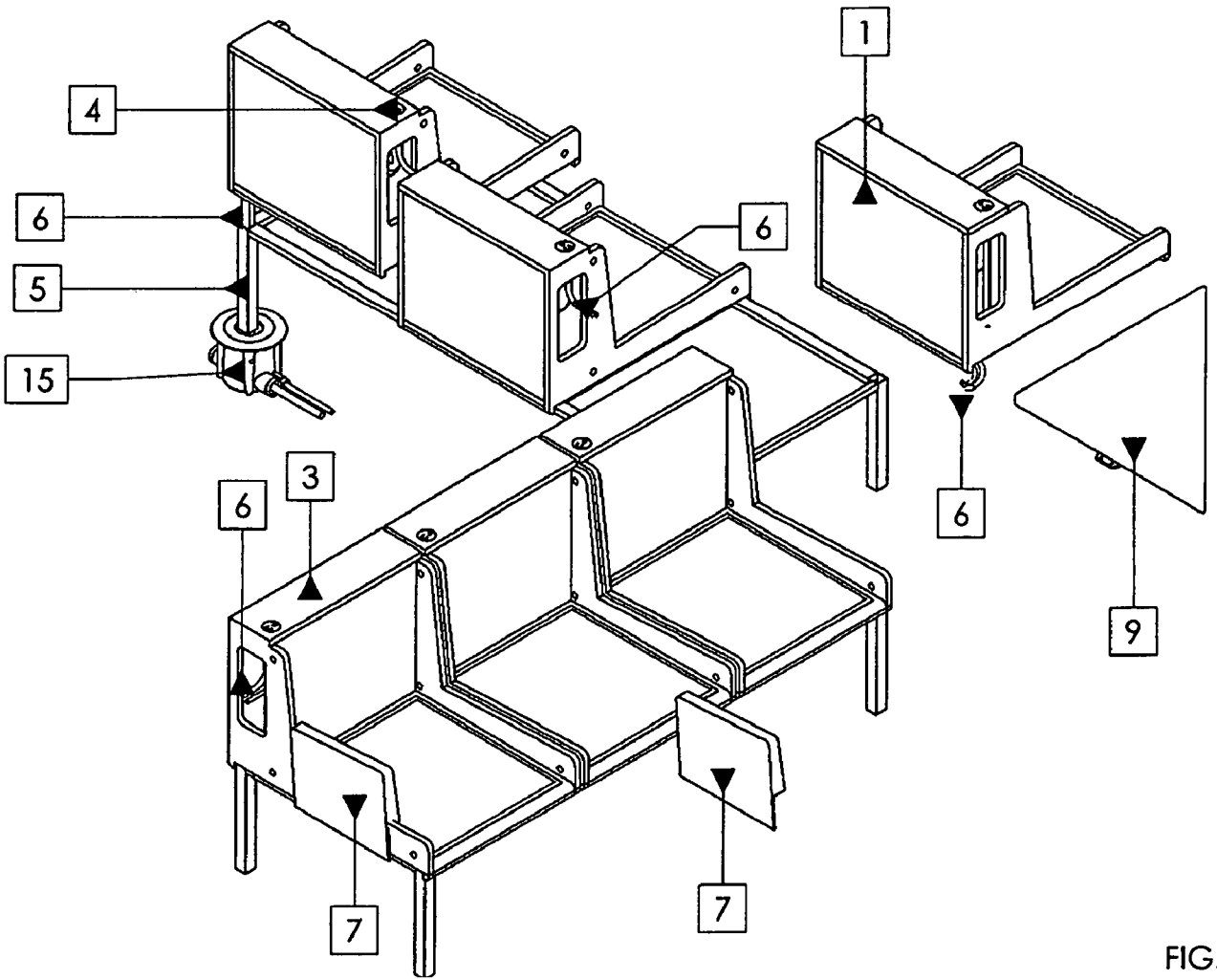

FIG. 4 is a partially exploded view of a single row of tandem seats that are connected to a second row of tandem seats creating an outside corner for the sitters according to one preferred embodiment of the invention.

Figures 4A, 4B:
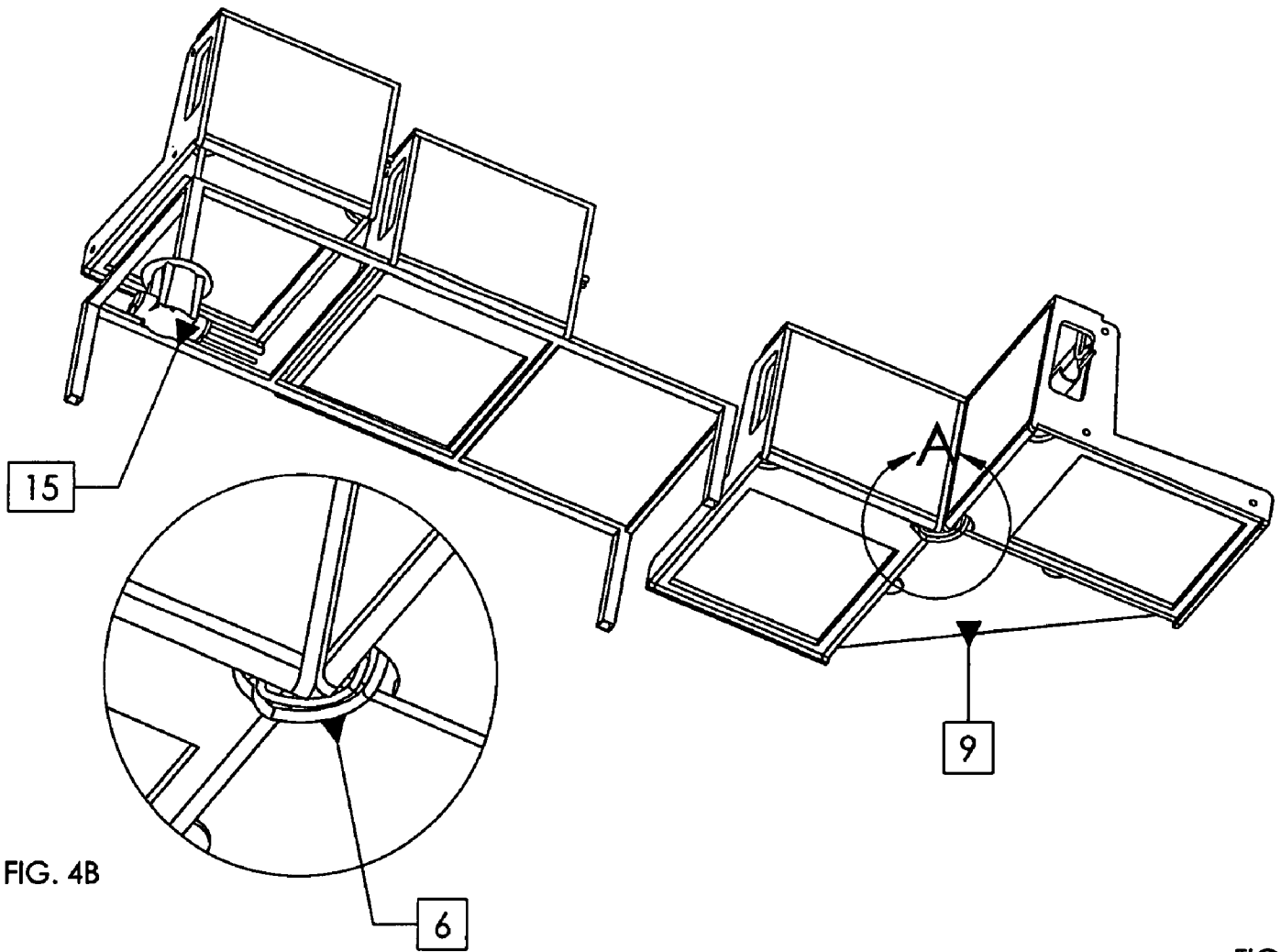

FIG. 4A is a rear bottom perspective of a single row of tandem seats that are connected to a second row of tandem seats creating an outside corner according one preferred embodiment of the invention.

FIG. 4B is an exploded view of the electrical wiring traversing the first and second single rows of tandem seats of FIG. 4A.

Figure 5:
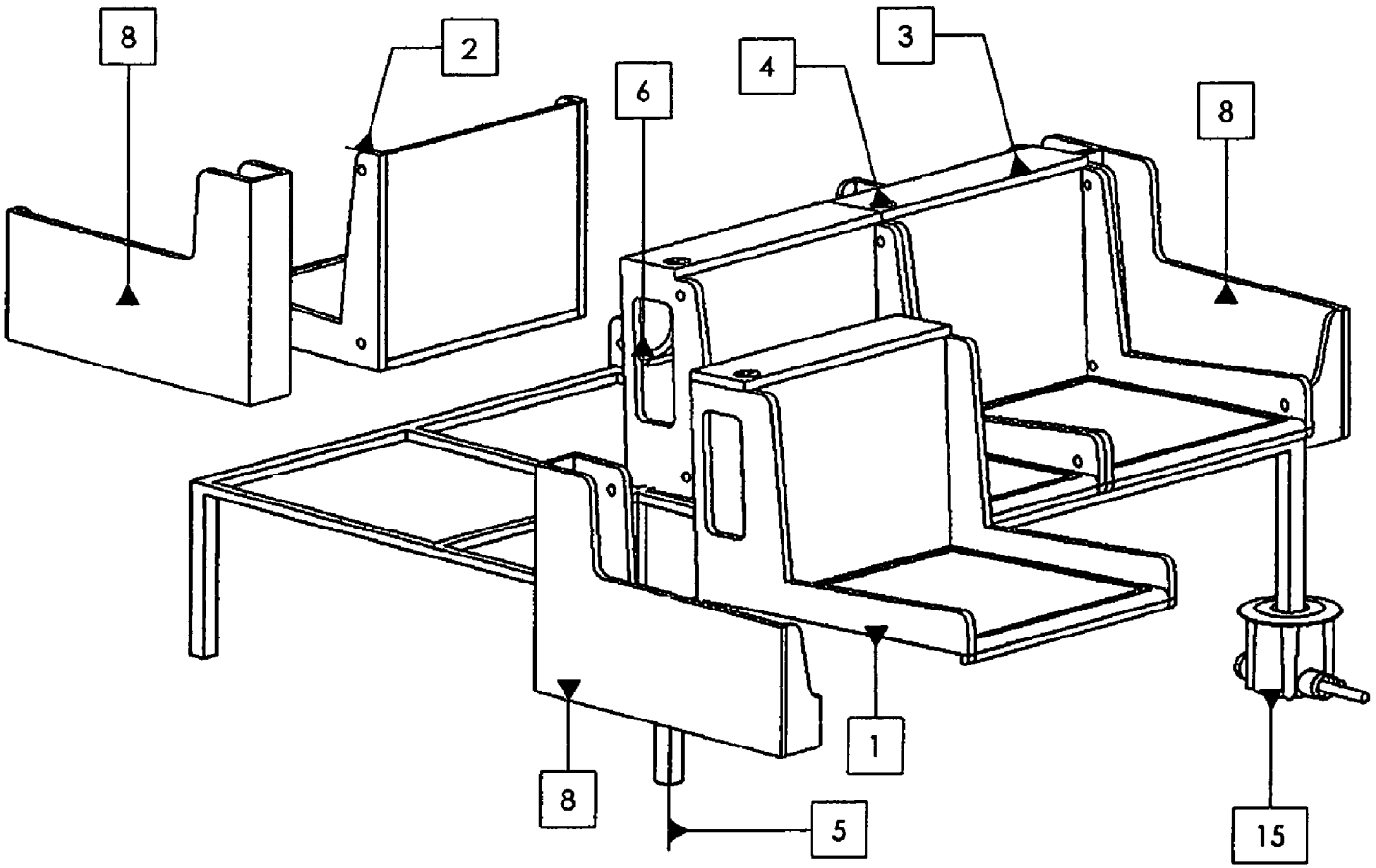

FIG. 5 is a partially exploded view of a back to back configuration of tandem seats according to one preferred embodiment of the invention.

Figure 6:
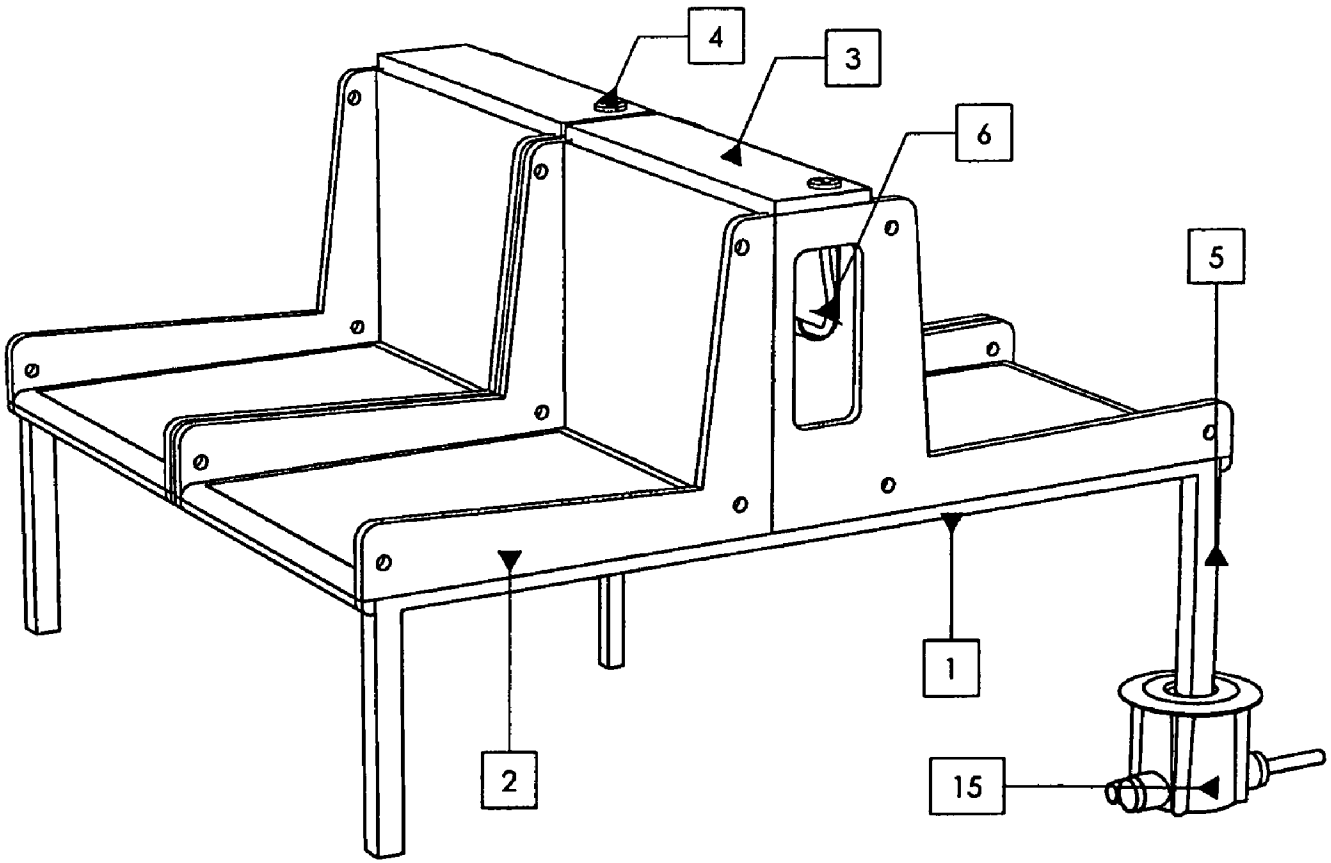

FIG. 6 is a side view of a back to back configuration of tandem seats according to one preferred embodiment of the invention.

Figure 7:
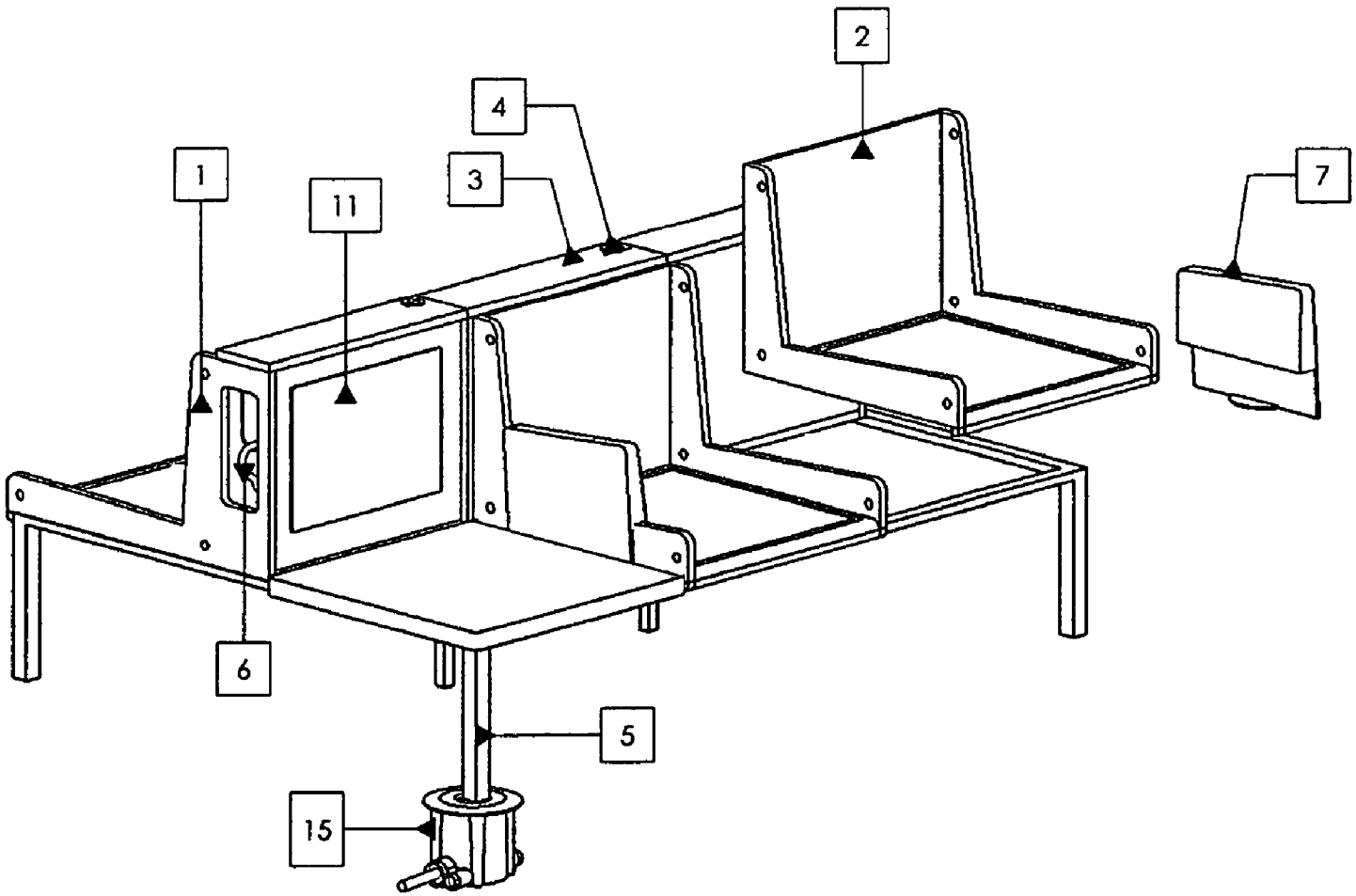

FIG. 7 is a front perspective of a back to back row of tandem seats with a monitor installed in the back of a seat frame according to one preferred embodiment of the invention.

Figure 8:
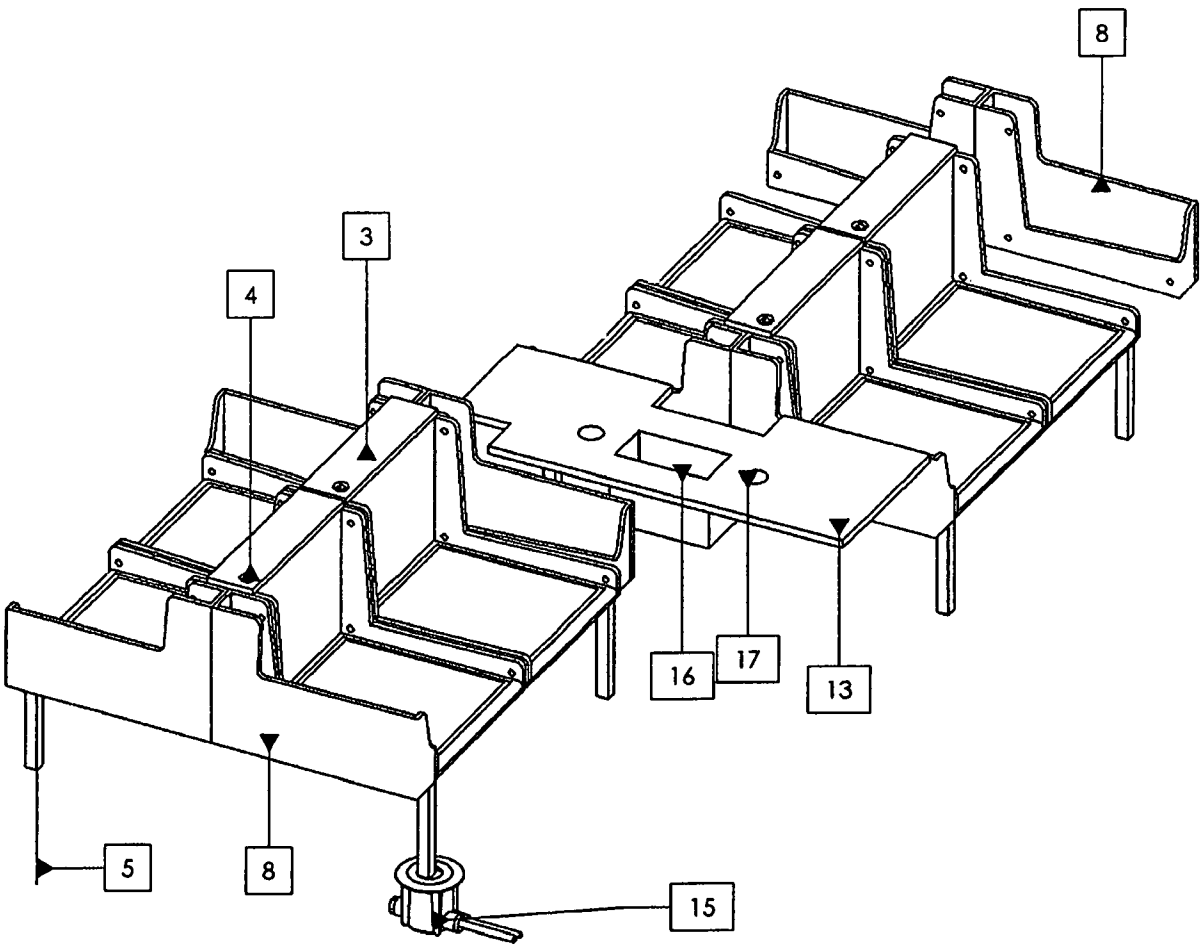

FIG. 8 is a top view of two seating systems composed of back to back tandem seats in which the systems are connected at a staggered distance by a table according to one preferred embodiment of the invention.

Figure 9:
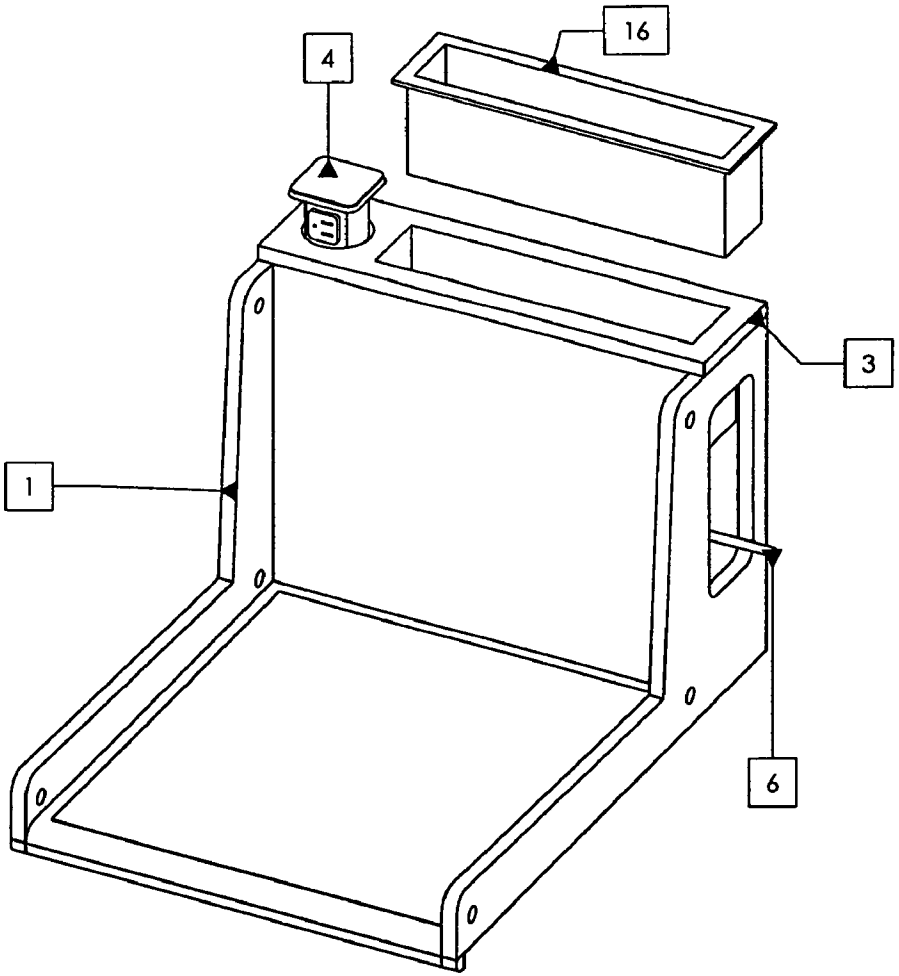

FIG. 9 is a partially exploded front view of a single seat frame showing an inset storage box, as well as an electrical port, in particular a power grommet, extending though an aperture in the cover plate according to one preferred embodiment of the invention.

Figure 10:
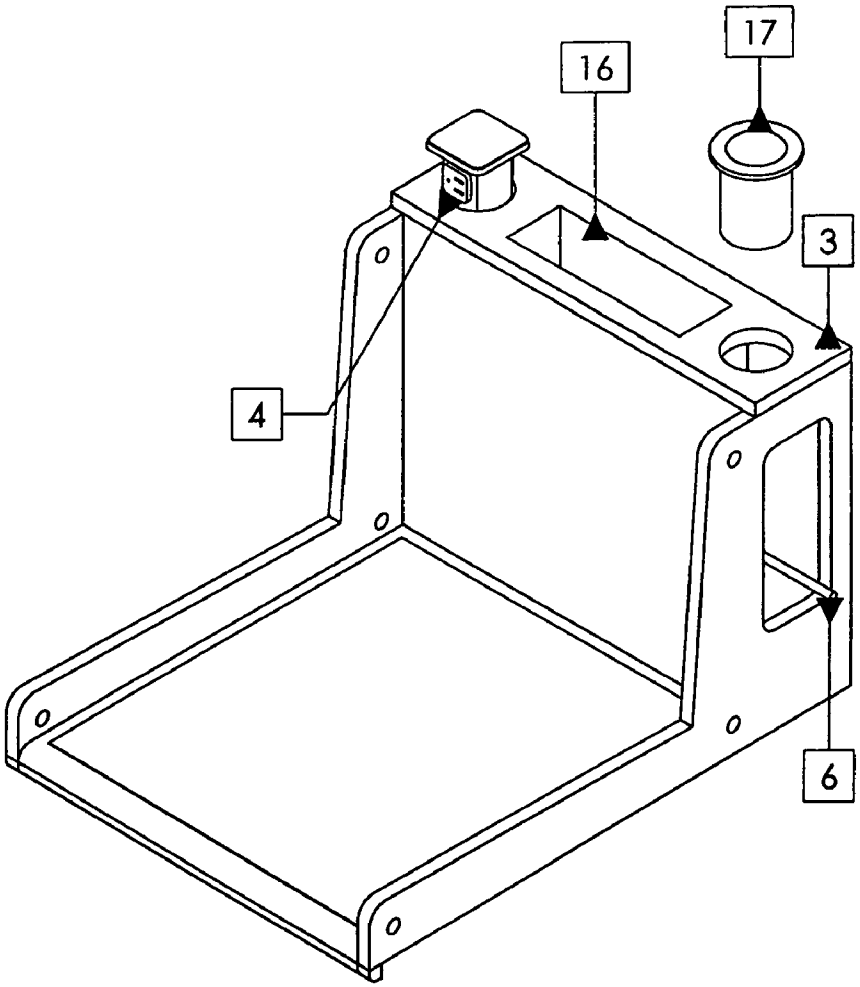

FIG. 10 is a partially exploded front view of a single seat frame showing an electrical port, in particular a power grommet, an inset storage box, and an inset cylindrical container which are accessible from the cover plate according to one preferred embodiment of the invention.

Figure 11:
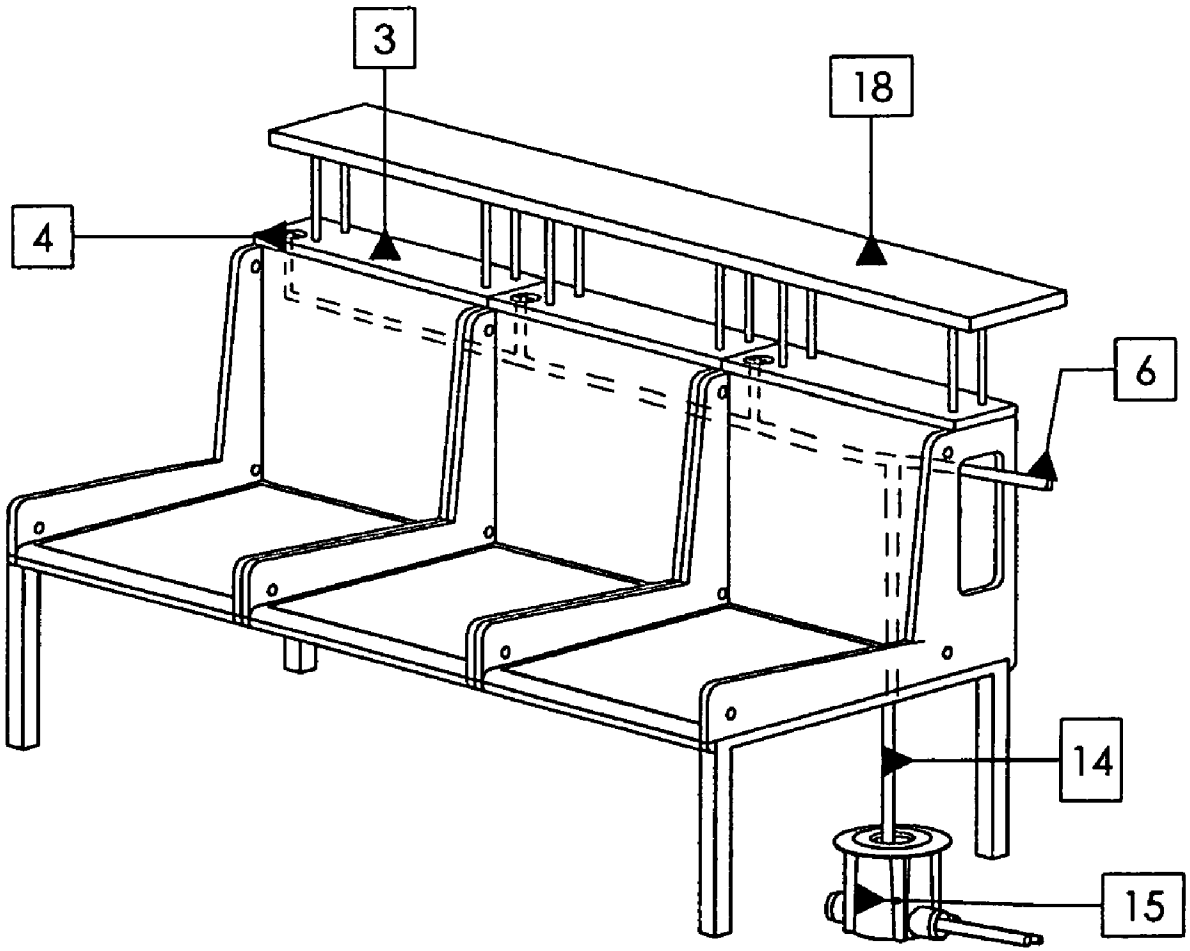

FIG. 11 is a front view of a single line of tandem seats with a table placed above the cover plate and optional routing for the electrical wiring.

Figure 12:
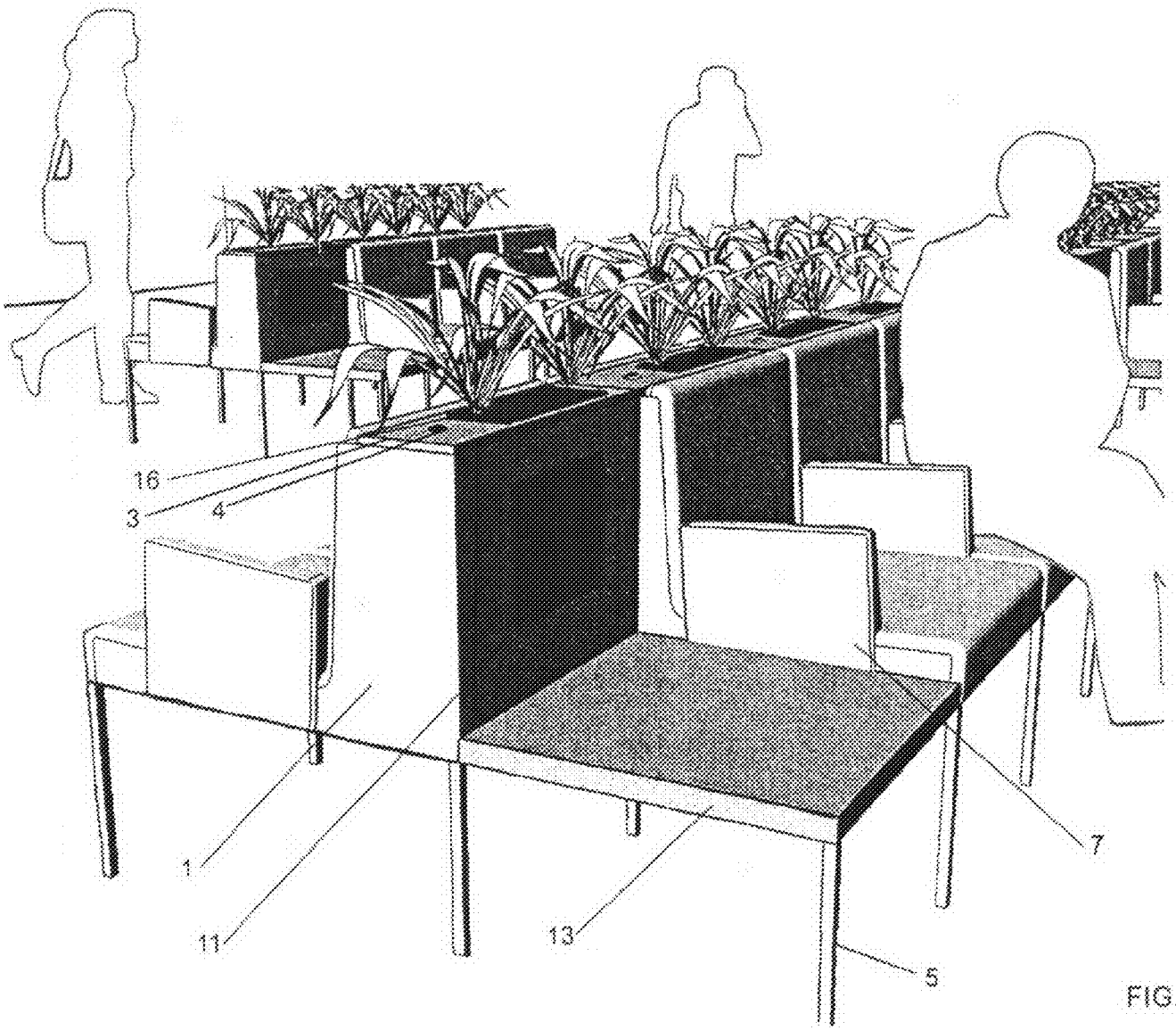

FIG. 12 is a front view of a waiting area which includes several rows of back to back tandem seats with a monitor installed in the back of a seat frame, as well as fake plants placed within a storage box inside the wire way, according to one preferred embodiment of the invention.

Figure 13:
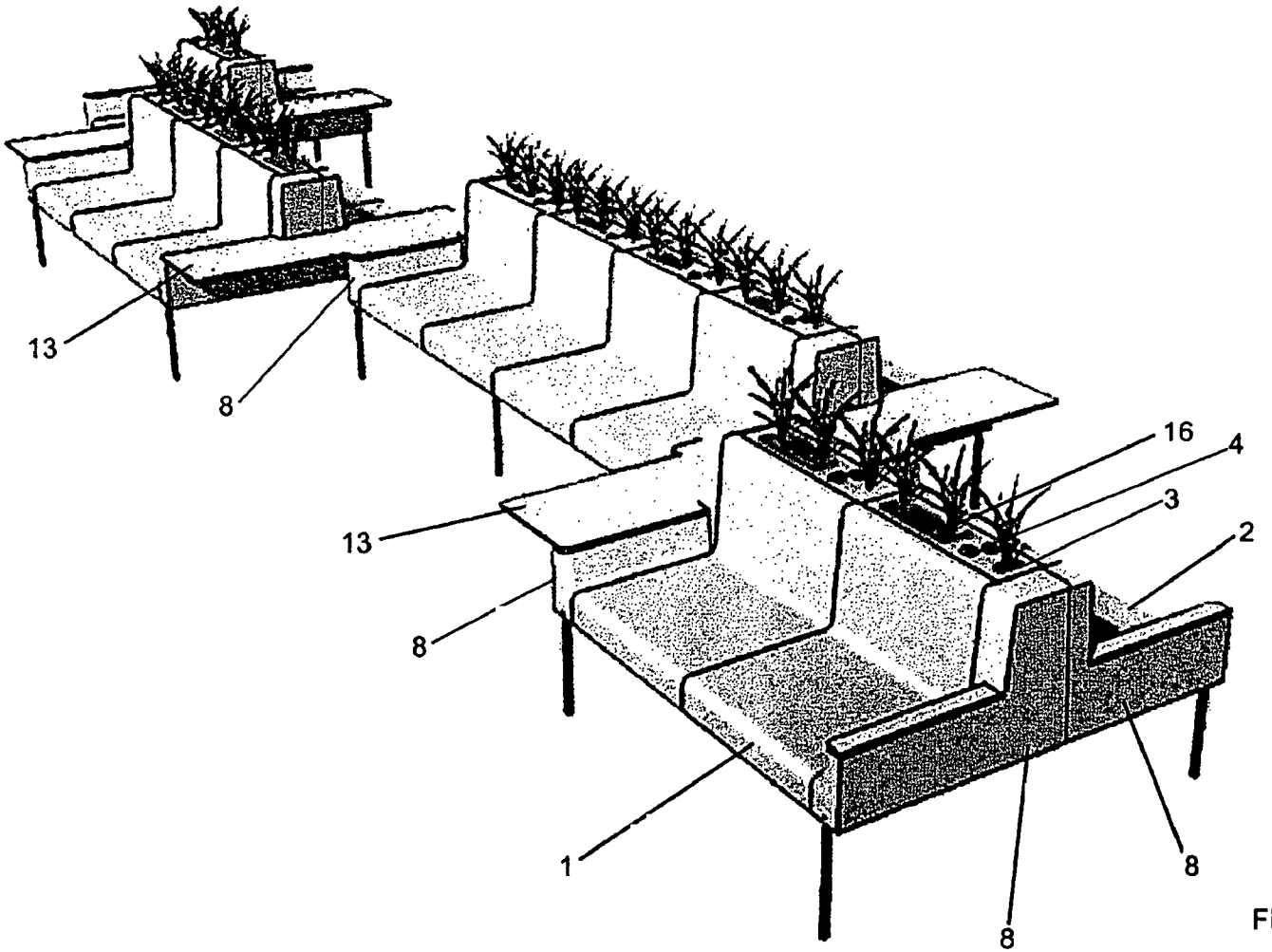

FIG. 13 is a front view of a waiting area which includes several seating systems composed of back to back tandem seats in which the systems are connected at staggered distances by a table, and fake plants are placed within a storage box inserted into the cover plate and inside the wire way, yet leaving electrical/data ports accessible, according to one preferred embodiment of the invention.

Figure 13A:
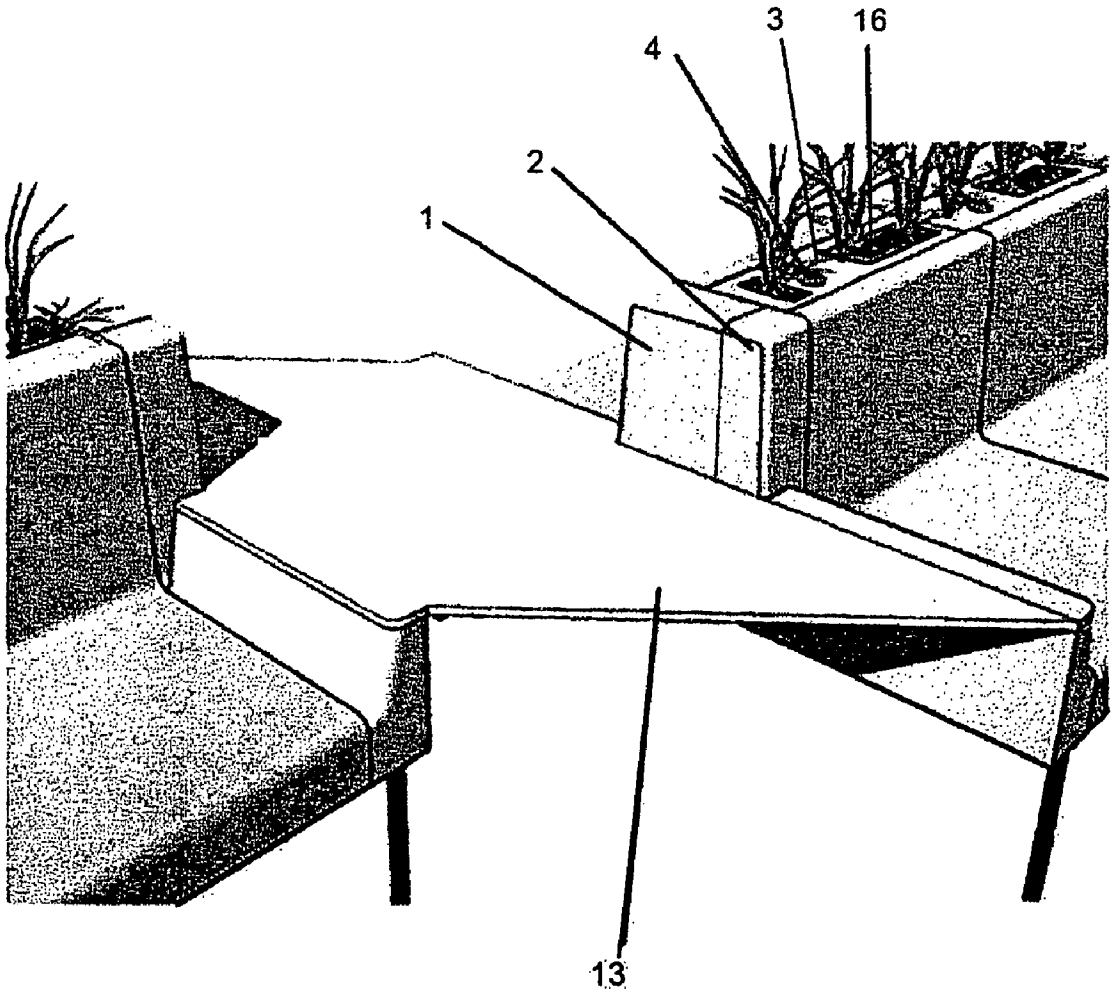

FIG. 13A is a front view of the staggered seating system illustrated in FIG. 13 showing the connection of the back to back seating systems by a table according to one preferred embodiment of the invention.

Figure 14:
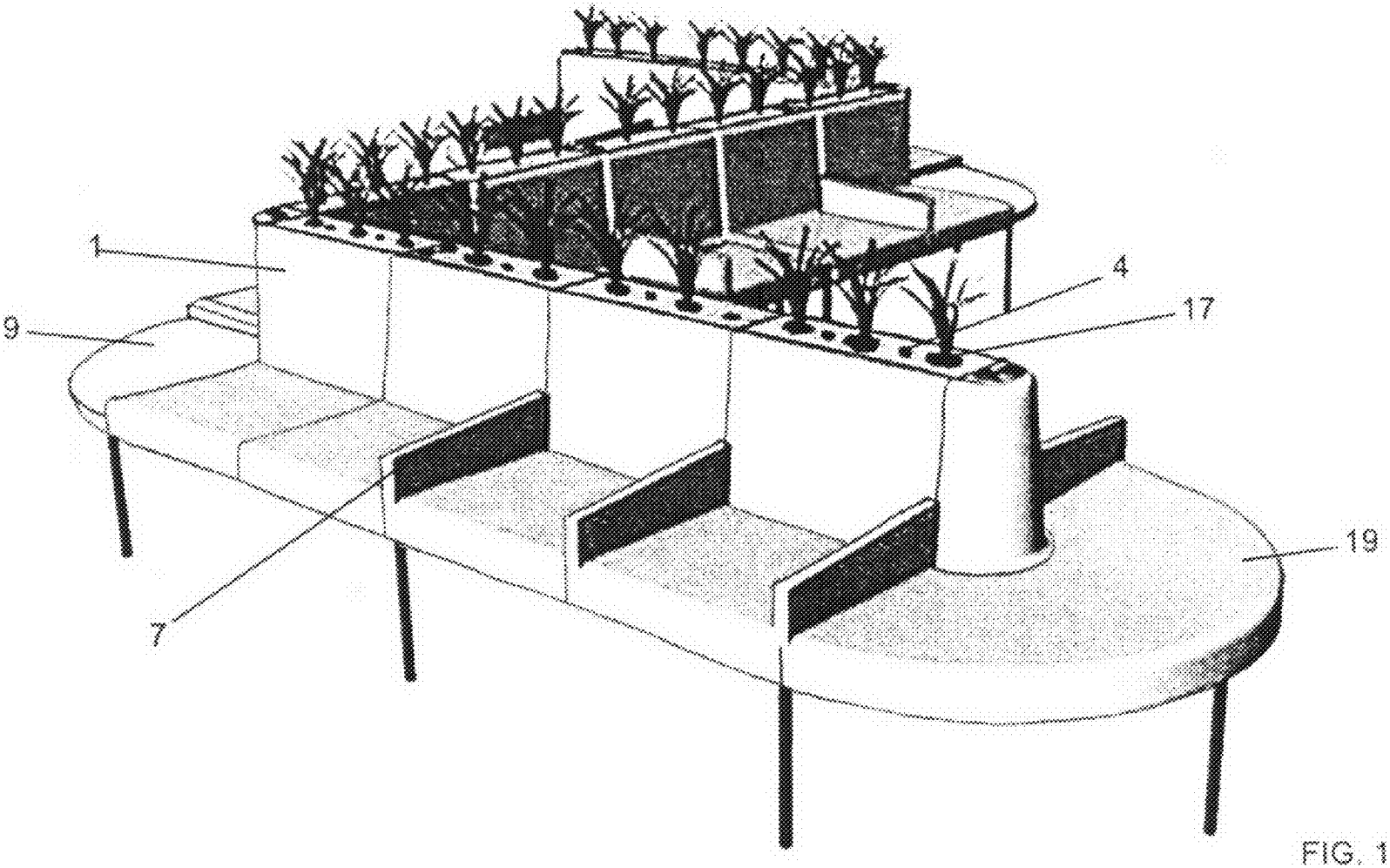

FIG. 14 is a front view of a waiting area which includes several rows of back to back tandem seats connected to form both inside and outside corners, with banquet seats at the terminal ends of the seating system, according to one preferred embodiment of the invention. Fake plants are placed within cylindrical containers inserted into the cover plate and positioned inside the wire way, while electrical/data ports remain accessible.

Figure 15:
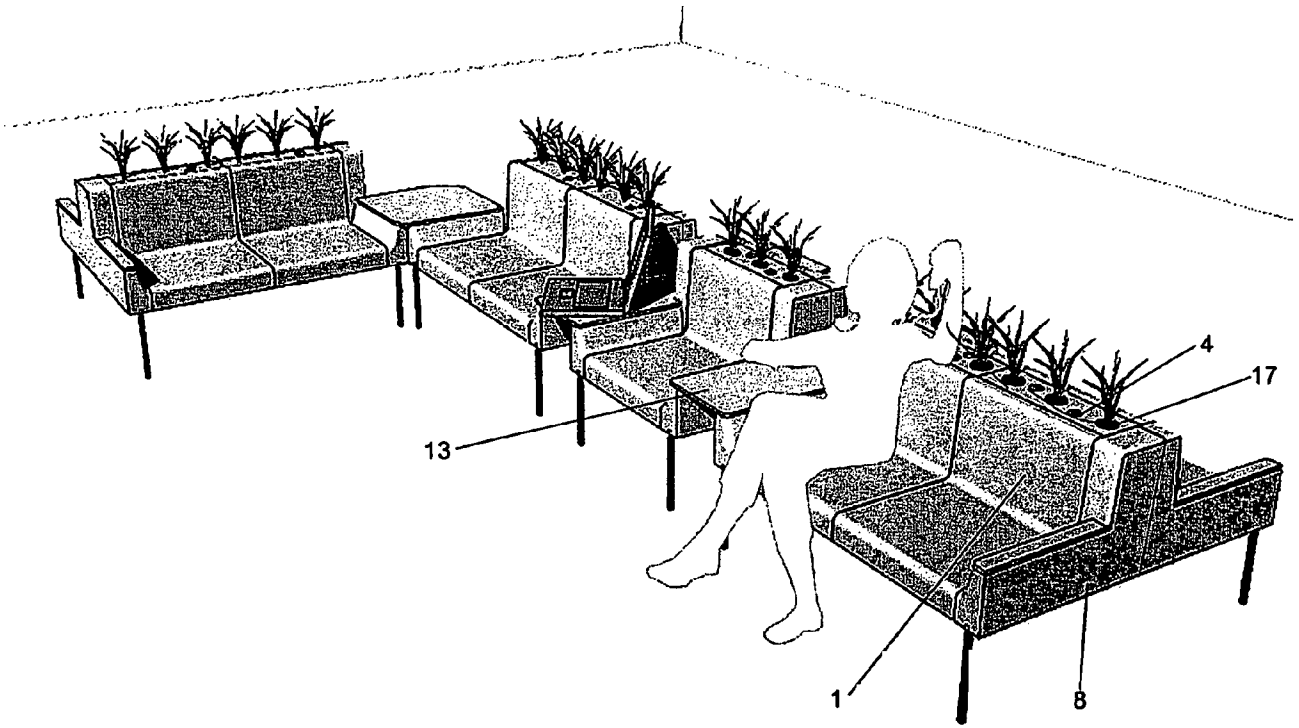

FIG. 15 is a front view of a waiting area which includes several rows of back to back tandem seats connected by tables, either in a single line or forming a corner, according to one embodiment of the invention. Fake plants are placed within cylindrical containers inserted into the cover plate and positioned inside the wire way, while electrical/data ports remain accessible.

Figure 16:
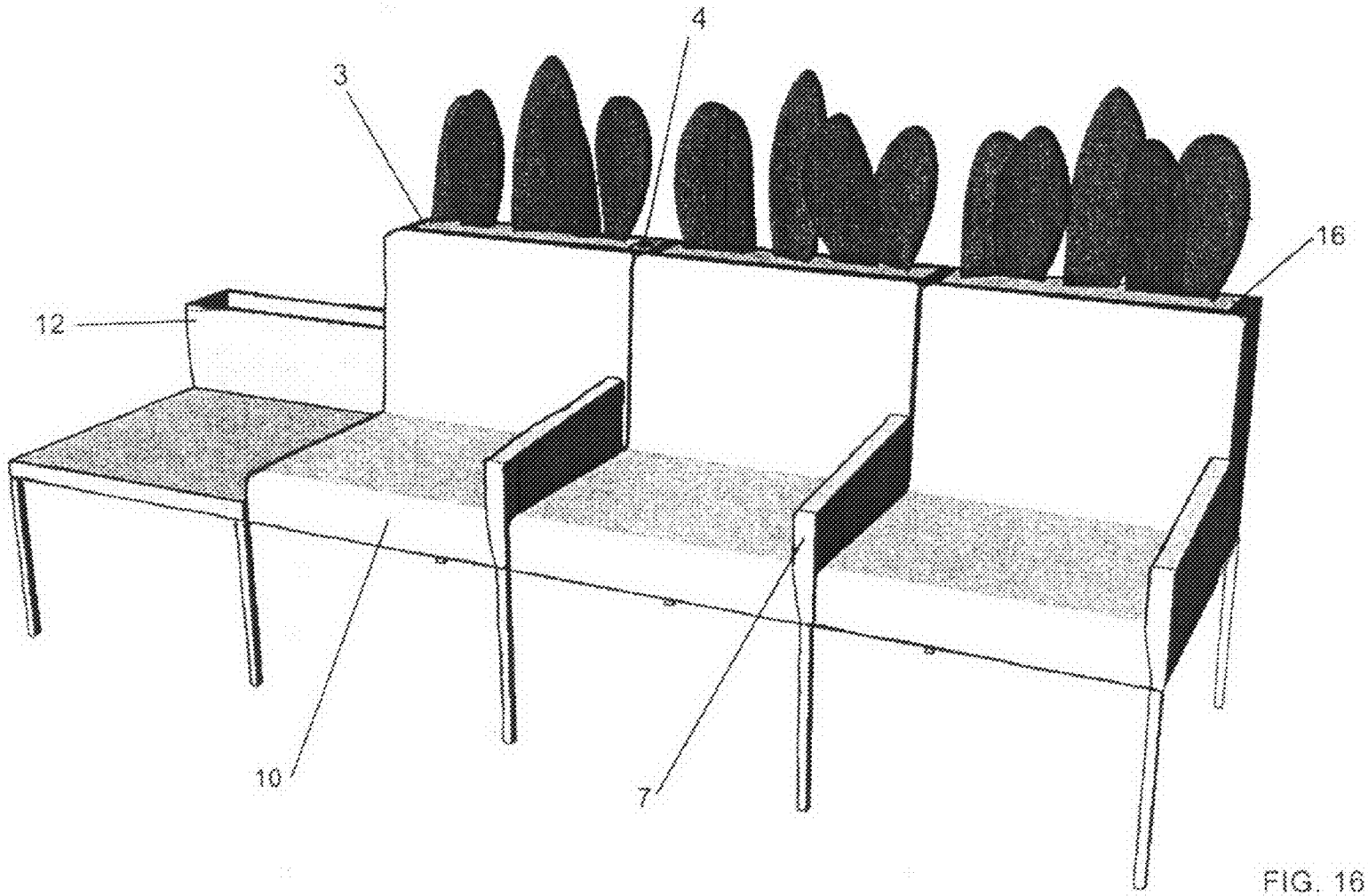

FIG. 16 is a front view of a single line of tandem seats showing a table with affixed storage box connected to one end of the seating system, as well as a storage box containing plants which is inserted into the cover plate and sits within the wire way according to one preferred embodiment of the invention.

Figure 17:
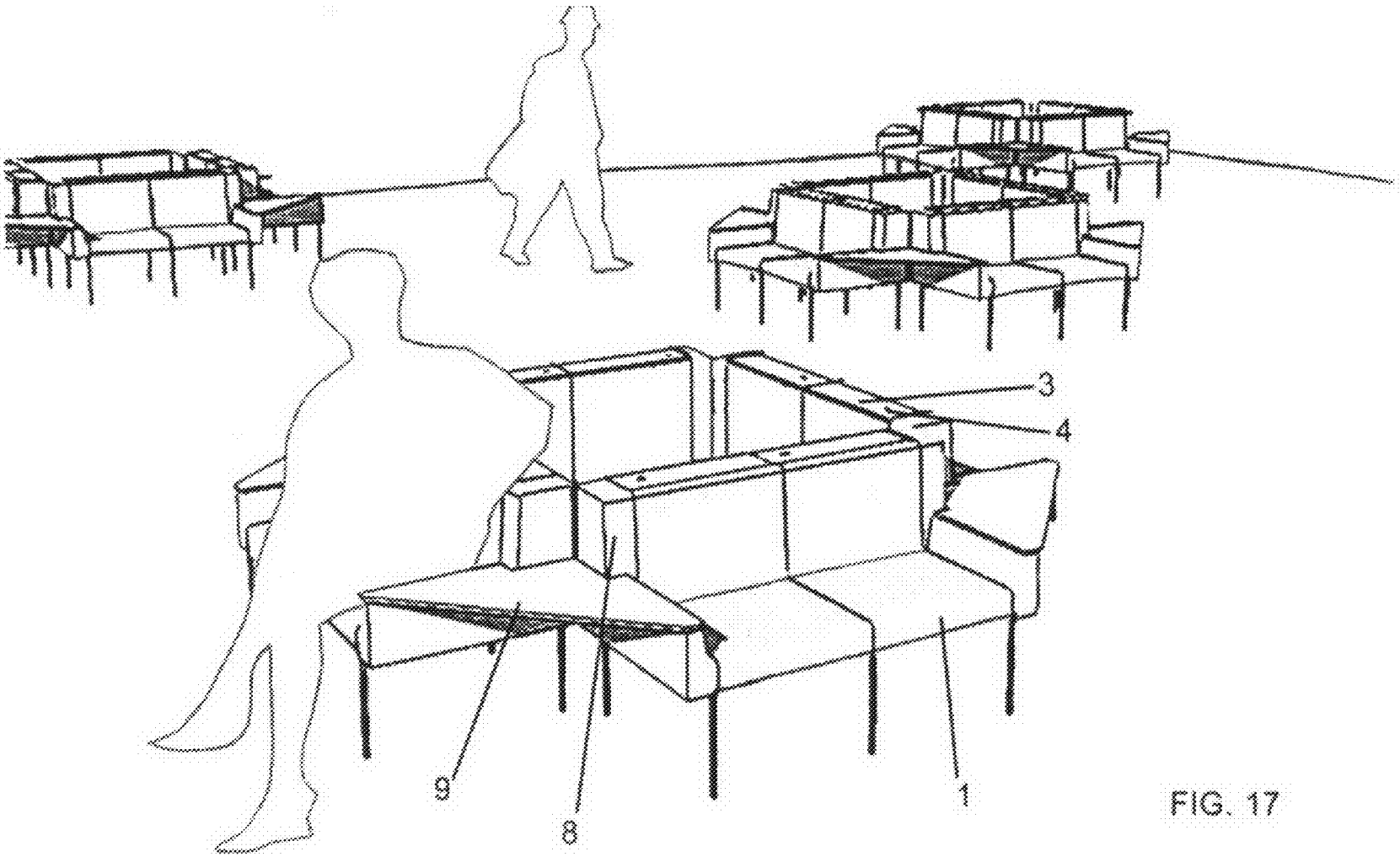

FIG. 17 is a front view of a waiting area which includes at least 4 single rows of tandem seats that are connected to form outside corners, thereby forming a parallelogram arrangement, according to one preferred embodiment of the invention.

Figure 18:
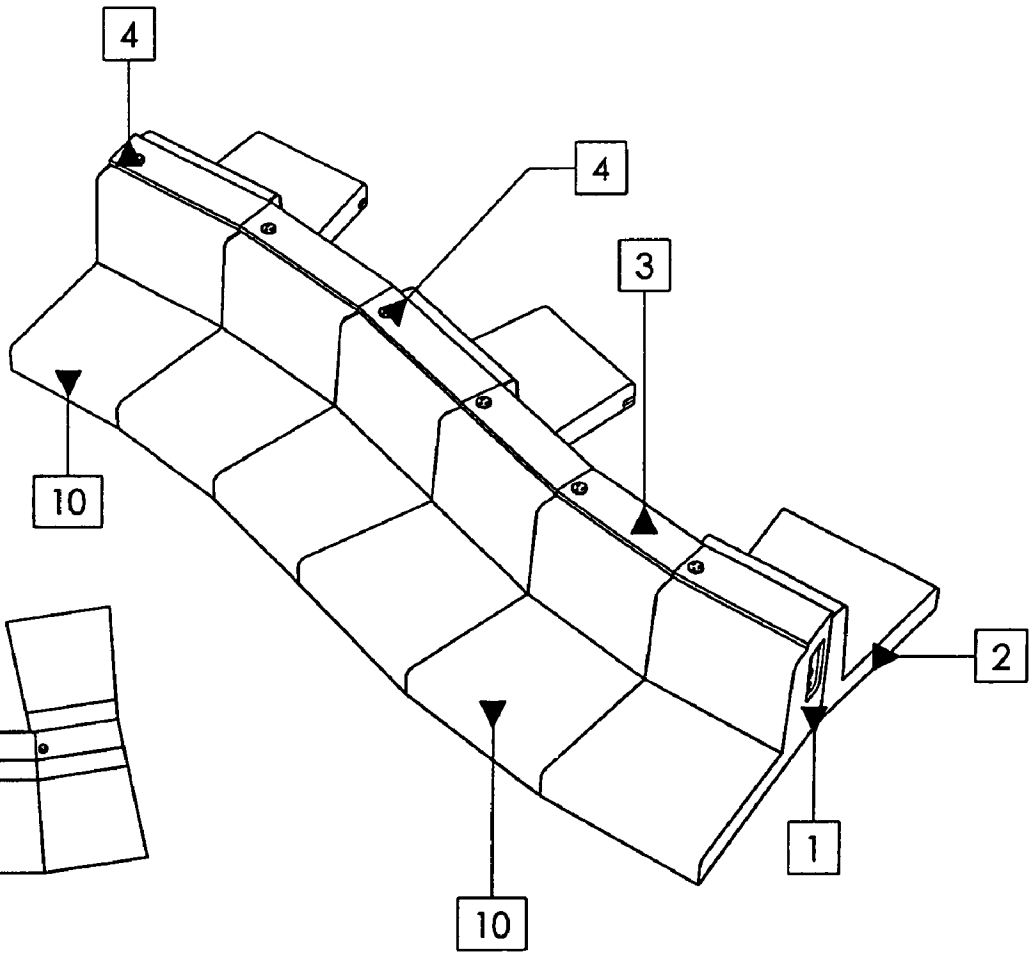

FIG. 18 is a front view of a row of back to back tandem seats forming an arc according to one embodiment of the invention.

Figure 18A:
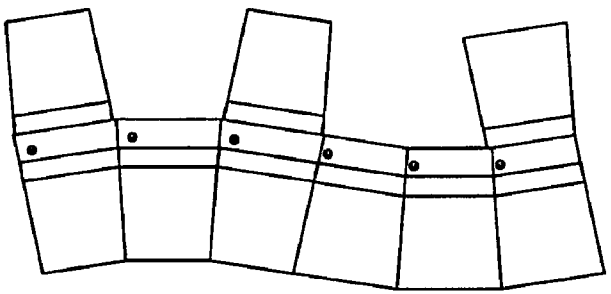

FIG. 18A is a top view of a row of back to back tandem seats forming an arc according to one embodiment of the invention.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

FIG. 1 is an isometric exploded view of a single seat frame with an electrical wire way 1 for the single line seating arrangement.

The embodiment illustrated in FIG. 1 includes a seat 10, which is connected to and abuts the electrical wire way. The seat 10 and electrical wire way are connected to a lower seat frame 5. An electrical floor box assembly 15 is connected to the lower seat frame 5 at a leg and provides the initial electrical source, such that the electrical wiring 6 traverses through a leg of the lower seat frame 5 and enters the electrical wire way at the top of the leg. Ideally, the electrical floor box assembly 15 is below floor level, such that the top of the box is flush with the floor, so as to prevent tripping on the box.

A cover plate 3 extends over the top portion of the wire way. Cover plate 3 can be hinged or cleated, and it is suggested that there be a locking mechanism. Electrical/data port 4 extends through an aperture in the cover plate 3 and is connected to the electrical wiring 6 within the wire way. This illustration is only a suggestion for the placement and type of the electrical/data port 4. The arrangement and number of outlets would be determined by the specifier.

An optional lounge arm frame 8 may be connected to either the left, right or both sides of the seat 10.

FIG. 1A is a back view of an exploded view of a single seat frame showing the path the electrical wiring 6 takes through the seating system according to one embodiment of the invention. Beginning at an electrical floor box assembly 15, the electrical wiring 6 traverses through the leg of lower seat frame 5, exits the seat frame at the top of a leg, enters the seat frame with an electrical wire way 1 through an aperture at the bottom of the wire way and proceeds through the wire way with a portion of the wiring terminating at the cover plate.

FIG. 1B is an exploded view of a single seat frame showing the placement of an electrical floor box assembly relative to the floor according to one embodiment of the invention. In this preferred embodiment, the electrical floor box assembly 15 is below floor level, such that the top of the box is flush with the floor, so as to prevent tripping on the box. As noted in FIG. 1, the electrical floor box assembly 15 is connected to the lower seat frame 5 at a leg and provides the initial electrical source, such that the electrical wiring 6 traverses through a leg of the lower seat frame 5, enters the electrical wire way at the top of the leg, and a portion of the electrical wiring 6 terminates in an electrical port 4.

FIG. 1C is an exploded side view of a single seat frame with electrical wire way 1 showing the connection of the electrical floor box assembly 15 to the lower leg frame 5, wherein the box is below the floor.

FIG. 1D is a closer view FIG. 1B, showing the placement of the electrical floor box assembly 15 relative to the floor.

FIG. 2 is an isometric view of a single seat unit with a cover plate 3 open for access to the electrical wiring 6. It is preferred that the cover plate be hinged or cleated to the wire way. It is further preferred that the cover plate have a locking mechanism. The electrical wiring 6 passes through the wire way and a portion of the electrical wiring ends in an electrical port 4, while the remainder of the electrical wiring continues through the wire way. In this particular embodiment of the invention, the electrical port 4 extends through an aperture in the cover plate and is thus accessible from the surface of the cover plate 3 when the cover plate 3 is closed. However, how the electrical ports 4 are installed, whether onto or under the top plate, will be specified by the user, depending on an indoor or outdoor installation of the seating system. Furthermore, the type of electrical port will be specified by the user. One preferred embodiment uses a power grommet, such as a Douglas Mockett PCS39/EEHW power grommet, as the electrical port. Electrical outlets and installation desirably are child-safe for indoor or outdoor use and grounded for outdoor use.

FIG. 3 is an isometric partially exploded view of a single line of tandem seats with an electrical wire way 1 connected to a second single line of tandem seats with an electrical wire way 1, and a corner table 9 spanning the inside of the corner. In the first and second single line of tandem seats, seats 10 abut the electrical wire way and both the seats and wire way are placed on top of and connected to lower seat frame 5. A cover plate 3 extends over the wire way, and at least one electrical/data port 4 is accessible from the cover plate. In one preferred embodiment an electrical charging plate can plugged into an electrical port 4 and positioned on the cover plate.

The first and second single lines of tandem seats are connected to form an inside corner. On the inside corner seating arrangement two persons on either side of the corner table would be sitting facing toward one another. Each single line of tandem seats has a lounge arm frame 8 connected to the seats 10 forming the inside corner. The lounge arm frames 8 of the first and second single line of tandem seats are fixed together at the inside corner. A corner table 9 spans between and is connected to the lounge arms frames 8 of both the first and second single lines of tandem seats. The corner table can take any shape spanning between the seat units.

In the particular embodiment of FIG. 3, the electrical wiring 6 extends through a rear leg of the lower seat frame 5 of one of the single lines of tandem seats and into wire way. The same electrical wiring 6 extends through both the first and second single line of tandem seats by traversing through the lounge arm frames 8, as more fully shown in FIG. 3A.

FIG. 3A is a partially exploded rear bottom view of two seats that are connected to create an inside corner, as shown in FIG. 3. The electrical wiring 6 exits the wire way of the first single line of tandem seats, travels through the rear end of the lounge arm frame 8 to the front of the arm where it exits through an aperture in the arm and enters an aperture at the front of the lounge arm frame 8 connected to the second single line of tandem seats. The electrical wiring 6 traverses a similar path in the second single line of tandem seats as it did in the first single line of tandem seats.

FIG. 3B is a rear bottom perspective of an inside corner created by two single lines of tandem seats wherein the corner table 9 is connected to the seats of the seating system, rather than lounge arms as shown in FIGS. 3 and 3A. In this preferred embodiment, the electrical wiring 6 traverses the single line of seats with an electrical wire way 1, exits the wire way through an aperture in the rear, traverses along the edge of the corner table 9, and enters a second line of single seats with an electrical wire way 1 through an aperture in the rear of the second wire way.

FIG. 4 is a partially exploded isometric view of a single line of tandem seats with an electrical wire way 1 connected to a second single line of tandem seats with an electrical wire way 1 having a corner table 9 spanning the outside corner. In the first and second single line of tandem seats, seats 10 abut the wire way and both the seats and wire way are placed on top of and connected to lower seat frame 5. A cover plate 3 extends over the wire way 1, and at least one electrical/data port 4 is accessible from the cover plate for each seat.

The first and second single lines of tandem seats are connected to form an outside corner. On the outside corner seating arrangement two persons on either side of the corner table would be sitting facing away from one another. In this preferred embodiment, an arm frame 7 may be placed at either the terminal ends of the seat rows or to the left, right or both sides of an individual seat 10. Arm frame 7 does not cover the wire way. The first and second single lines of tandem seats are fixed together at the outside corner where the wire ways of each line of seats meet. A corner table 9 spans the outside corner, connected to seats 10 of both the first and second single lines of tandem seats. A triangular shaped corner table 9 is shown. The triangular shaped shape is only suggested; the corner table can take any shape spanning between the seat units.

In this preferred embodiment, an electrical floor box assembly 15 is connected to the lower seat frame 5 at a leg and provides the initial electrical source, such that the electrical wiring 6 traverses through the leg of the lower seat frame 5 and enters the electrical wire way at the top of the leg. The same electrical wiring extends through both the first and second single lines of tandem sheets, as more fully shown in FIGS. 4A and 4B.

FIG. 4A is a partially exploded rear view of the first and second single lines of tandem seats illustrated and described in FIG. 4 showing the electrical wiring traversing from the first single line of tandem seats into the second line of tandem seats.

FIG. 4B is a closer view of the electrical wiring 6 traversing the first and second single lines of tandem seats. The electrical wiring 6 exits the wire way of the first single line of tandem seats through an aperture at the bottom of the wire way and enters into the second wire way through an aperture at the bottom of the second wire way of the second line of tandem seats.

FIG. 5 is a partially exploded isometric view of a back to back seating arrangement which includes a seat frame without an electrical wire way 2. The electrical wiring 6 only extends through a first seating arrangement with an electrical wire way 1. For the first seating arrangement with an electrical wire way 1, seats 10 abut the wire way and both the seats and wire way are placed on top of and connected to lower seat frame 5. In the second seating arrangement without an electrical wire way 2, the seats 10 are also placed on top of and connected to lower seat frame 5, such that the second seating arrangement abuts wire way of the first seating arrangement. A cover plate 3 extends over the wire way, and at least one electrical/data port 4 is accessible from the cover plate for each seat. In this preferred embodiment, persons sitting in either the first or second arrangement of the back to back seats have access to the electrical/data ports 4.

An electrical floor box assembly 15 is connected to the lower seat frame 5 at a leg and provides the initial electrical source, such that the electrical wiring 6 traverses through the leg of the lower seat frame 5 and enters the electrical wire way at the top of the leg.

This seating arrangement can be in a straight line or an arc of seating units. The back to back arrangement might include an inside or outside corner table that would be attached and situated similarly to FIGS. 3 and 4. The seating system may have a lounge arm frame 8 at the terminal ends of the seat rows.

FIG. 6 is an isometric side view of the back to back seating arrangement more fully described in FIG. 5.

FIG. 7 is a partially exploded view of a back to back seating arrangement which includes seat frames with an electrical wire way 1 and seat frames without an electrical wire way 2, as illustrated and described more fully in FIG. 5; however, the preferred embodiment of FIG. 7 includes a TV monitor 11 installed in the back of a single line seat frame which has an electrical wire way 1. This embodiment may include an arm frame 7.

FIG. 8 is a partially exploded isometric view of a back to back seating arrangement which includes seat frames with an electrical wire way 1 and seat frames without an electrical wire way 2. The back to back seating arrangement is more fully described with respect to FIG. 5.

This seating arrangement could be in a straight line or an arc of seating units. The back to back arrangement might include a table 13 that spans between and is connected to the lounge arm frames 8 of the back to back seating units. In this particular embodiment, two systems of the back to back seating arrangements are connected via a table 13 at staggered distances above and below an axis.

In one preferred embodiment, table 13 contains a storage box 16 and cylindrical containers 17 for storing various items such as storing periodicals or writing utensils, respectively.

An electrical floor box assembly 15 is connected to the lower seat frame 5 at a leg and provides the initial electrical source, such that the electrical wiring 6 traverses through the a leg of the lower seat frame 5 and enters the electrical wire way at the top of the leg. A portion of the electrical wiring 6 terminates at an electrical port 4 which is accessible from the cover plate 3.

FIG. 9 is a partially exploded front view of a single seat frame showing an inset storage box 16. The storage box 16, which may be used for holding periodicals or fake plants or other items to support the task of waiting, is inserted into the cover plate and fits conveniently into the wire way without disturbing any wires. An electrical port 4, in this embodiment a power grommet, is connected to the electrical wiring 6 and extends through an aperture in the cover plate. One preferred embodiment includes a Douglas Mockett PCS39/EEHW power grommet. Given that the power grommet encloses the electrical power source, the grommet is ideal for places where liquids could spill.

FIG. 10 is a partially exploded front view of a single seat frame showing an inset storage box 16, an electrical port 4, and a cylindrical container 17 which is inserted into the cover plate and fits conveniently into the wire way without disturbing any wires. Cylindrical container 17 may be used for holding smaller items, such as writing utensils or fake plants.

FIG. 11 is a front view of a single line of tandem seats with an electrical wire way 1 and a table 18 connected to the surface of the cover plate 3. In this embodiment, the electrical/data ports 4 and any chargers positioned on the cover plate remain accessible to the user who is sitting or the user who is standing at the table. The table can be used for any waiting past-time; however, it is suggested to function as a flat and stable surface for computers or writing.

In this particular embodiment, the electrical wiring 6 enters the wire way through optional routing 14. In the event it is not possible or not ideal to have the electrical wiring 6 extend through a leg or base of the seating system, the optional routing 14 allows the seating system to gain access to an electrical floor box assembly 15 no matter where the electrical source is located. In such an embodiment, the electrical wiring 6 extends from the electrical floor box assembly 15, through the optional routing 14, and may enter the wire way at any location.

FIG. 12 is a front view of a waiting area which includes several rows of back to back tandem seats with a TV monitor 11 installed in the back of a single line seat frame with an electrical wire way 1. A table 13 extends beneath the monitor and sits on lower seat frame 5. In this particular embodiment, arm frames 7 separate individual seats 10. Storage boxes 16 are inserted through the cover plate 3 and positioned within the wire way. Here, the storage boxes support fake plants. Electrical/data ports 4 are still accessible to the user from the portion of the cover plate 3 that surrounds the storage box 16.

FIG. 13 is a front view of a waiting area which includes several seating systems composed of back to back tandem seats, which includes seat frames with an electrical wire way 1 and seat frames without an electrical wire way 2. Lounge arm frames 8 are connected to the terminal ends of each row of back to back tandem seats. In this particular embodiment, the rows of back to back seats are connected by tables 13, which span between and are connected to the lounge arm frames 8 of the back to back seating units, at staggered distances above and below an axis. Storage boxes 16 are inserted through the cover plate 3 and positioned within the wire way. Here, the storage boxes support fake plants. Electrical/data ports 4 are still accessible to the user from the portion of the cover plate 3 that surrounds the storage box 16.

FIG. 13A is a close-up view of the seating system described more fully in FIG. 13 showing the connection of the table 13 between the lounge arm frames 8 of each back to back seating arrangement.

FIG. 14 is a front view of a waiting area which includes several rows of back to back tandem seats connected to form both inside and outside corners, according to one preferred embodiment of the invention. Corner tables 9 span the outside orders. For the single line of tandem seats with an electrical wire way 1, cylindrical containers 17 are inserted into the cover plate without disturbing the electrical wiring in the wire way. Electrical/data plugs 4 are still accessible to the user from the portion of the cover plate that surrounds cylindrical containers 17. In this particular embodiment, the cylindrical containers support fake plants. At the most terminal ends of the seating system, banquet seats 19 connect to and span the distance between the back to back seats. Further, arm frames 7 may be randomly placed between each individual seat 10.

FIG. 15 is a front view of a waiting area which includes several rows of back to back tandem seats connected by a table 13 and configured in a single line and forming an inside corner, according to one embodiment of the invention. The table 13 connects the rows of tandem seats by being affixed to lounge arm frames 8. For the single line of tandem seats with an electrical wire way 1, cylindrical containers 17 are inserted into the cover plate without disturbing the electrical wiring in the wire way. Electrical/data ports 4 are still accessible to the user from the portion of the cover plate that surrounds cylindrical containers 17. In this particular embodiment, the cylindrical containers support fake plants.

FIG. 16 is a front view of a single line of tandem seats with an electrical wire way having a table with affixed storage box 12 connected to a terminal end of the row of seats. The table with affixed storage box 12 can be used to store a number of items, including, for example, periodicals. In this preferred embodiment, storage boxes 16 are inserted into the cover plate 3 without disturbing the electrical wiring in the wire way. Electrical/data ports 4 are still accessible to the user from the portion of the cover plate 3 that surrounds the storage boxes 16. In this particular embodiment, the storage boxes support fake plants.

FIG. 17 is a front view of a waiting area which includes several seating systems composed of at least 4 single rows of tandem seats with an electrical wire way 1 that are connected to form outside corners. The rows of tandem seats are configured to form a parallelogram arrangement. Lounge arms 8 are attached to the terminal end of each single row of tandem seats. Corner tables 9 are affixed to the lounge arms 8 and span the outside corners. Electrical/data ports 4 are accessible to the user from the surface of the cover plate 3.

FIG. 18 is a front view of a row of back to back tandem seats forming an arc according to one embodiment of the invention. A first single row of tandem seat frames with an electrical wire way 1 are arranged in an arc formation. A seat frame without an electrical wire way 2 may be connected to the first single row of tandem seat frames with an electrical wire way 1 at random intervals. The shape and size of the seats 10 can be varied to accommodate the arrangement the specifier desires. The electrical/data ports 4 are accessible from the cover plate 3 to persons sitting in any seat of this configuration.

FIG. 18A is a top view of a row of back to back tandem seats forming an arc more fully described in FIG. 18 according to one embodiment of the invention.

In one particularly preferred embodiment, the following parts are incorporated into the seating system: a row of tandem seat frames with an electrical wire way 1; a row of tandem seat frames without an electrical wire way 2; a cover plate 3; electrical and/or data ports 4; a lower seat frame 5; electrical wiring 6; an arm frame 7; a lounge arm frame 8; a corner table 9; a seat 10; a monitor 11; a table with affixed storage box 12; a table 13; optional routing for electrical wiring 14; an electrical floor box assembly 15; a storage box 16; a cylindrical container 17; a high table 18; and a banquet seat 19.

I claim:

1. A seating system comprising:

a) a configuration of a single line of tandem seats, each seat having a seat base and a seat back;

b) a wire way within which electrical and data wires extend, wherein the wire way is connected to each seat back in said single line of tandem seats;

c) said wires traversing at least a portion of the wire way;

d) said wires having an electrical connector at a terminal end; and e) a cover plate pivotably connected to and extending over the wire way for each seat, wherein at least one port connected to said wires, selected from the group consisting of an electrical port, a data port and a combination thereof, is accessible from a top surface of the cover plate.

2. The seating system of claim 1 further comprising a second single line of tandem seats connected to the back of said system.

3. The seating system of claim 2 comprising a first row of seats connected to a second row of seats by a table.

4. The seating system of claim 1 further comprising a TV monitor mounted on the backside of the wire way and connected to said wires.

5. The seating system of claim 1 further comprising at least one arm frame attached to at least one side of one seat.

6. The seating system of claim 5 wherein said arm frame comprises upholstery.

7. The seating system of claim 6 wherein said upholstered arm frame comprises a sustainable material.

8. The seating system of claim 1 further comprising upholstered seats.

9. The seating system of claim 8 further comprising upholstered seats made of a sustainable material.

10. The seating system of claim 1 comprising a first and a second row of seats connected to form an inside corner.

11. The seating system of claim 10 further comprising a table placed on said inside corner.

12. The seating system of claim 1 comprising a first and a second row of seats connected to form an outside corner.

13. The seating system of claim 12 further comprising a table placed on said outside corner.

14. The seating system of claim 1 comprising a first row of seats connected to a second row of seats by a table.

15. The seating system of claim 1 further comprising said seats forming an arc.

16. The seating system of claim 1 wherein the electrical port is a power grommet.

17. The seating system of claim 1 further comprising a meter connected to at least one of the group consisting of said electrical port, said data port, and a combination thereof.

18. The seating system of claim 17 further comprising an interface for said meter to activate said port upon receipt of an activation signal.

19. The seating system of claim 1 wherein said cover plate further comprises a storage box.

20. The seating system of claim 1 where said cover plate further comprises a cylindrical container.

* * * * *